US007490929B2

(12) United States Patent
Seino et al.

(10) Patent No.: US 7,490,929 B2
(45) Date of Patent: Feb. 17, 2009

(54) INK CARTRIDGE AND INK CARTRIDGE HOLDER

(75) Inventors: Takeo Seino, Nagano-ken (JP); Satoshi Fujioka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 87 days.

(21) Appl. No.: 11/747,501

(22) Filed: May 11, 2007

(65) Prior Publication Data

US 2007/0206076 A1 Sep. 6, 2007

Related U.S. Application Data

(60) Continuation of application No. 10/903,633, filed on Jul. 30, 2004, now Pat. No. 7,226,154, which is a division of application No. 10/391,274, filed on Mar. 18, 2003, now Pat. No. 6,832,830.

(30) Foreign Application Priority Data

Mar. 20, 2002 (JP) ..... 2002-079760

(51) Int. Cl.
*B41J 2/175* (2006.01)

(52) U.S. Cl. ..... 347/86; 347/85

(58) Field of Classification Search ..... 347/85–86, 347/40

See application file for complete search history.

(56) References Cited

U.S. PATENT DOCUMENTS 5,138,342 A 8/1992 Kurata et al.
5,138,344 A 8/1992 Ujita
5,861,897 A 1/1999 Ide et al.
5,992,975 A 11/1999 Gasvoda et al.
6,312,084 B1 11/2001 Ujita et al.

(Continued)

FOREIGN PATENT DOCUMENTS

CN 1 319 502 A 10/2001

(Continued)

OTHER PUBLICATIONS

Notification of Reasons for Refusal in JP 2003-77815 (Dec. 8, 2005), with English translation.

(Continued)

*Primary Examiner*—Thinh H Nguyen
(74) *Attorney, Agent, or Firm*—Stroock & Stroock & Lavan LLP

(57) ABSTRACT

An ink cartridge and an ink cartridge holder maintain the relative position between the information reading section of the ink cartridge holder and the information storing unit of the ink cartridge, which should be aligned accurately, even if the ink cartridge has instability to the ink cartridge holder due to variation in each product. The ink cartridge which supplies ink to a recording apparatus includes: a substantially rectangular parallelepiped ink cartridge main body holding ink; a connection electrode section provided on part of a first side of the ink cartridge main body and including a connection terminal; an ink supply unit provided in a front surface intersecting the first wall; and a positioning section guiding a positioning member of the recording apparatus to the vicinity of the connection electrode on the front surface so that the positioning member opposes the connection electrode section in the direction parallel with the connection electrode section.

18 Claims, 23 Drawing Sheets

U.S. PATENT DOCUMENTS

| | | | | |
|---|---|---|---|---|
| 6,331,041 | B1 | 12/2001 | Yoshimura et al. | |
| 6,966,631 | B2 * | 11/2005 | Matsuo et al. | 347/49 |
| 2001/0024225 | A1 | 9/2001 | Ishizawa et al. | |
| 2001/0045977 | A1 | 11/2001 | King et al. | |

FOREIGN PATENT DOCUMENTS

| | | | |
|---|---|---|---|
| EP | 1078760 | A2 | 2/2001 |
| EP | 1 120 258 | A2 | 8/2001 |
| EP | 1 138 502 | A2 | 10/2001 |
| EP | 1 164 025 | A1 | 12/2001 |
| EP | 1 219 441 | A2 | 7/2002 |
| EP | 1 247 651 | A2 | 10/2002 |
| GB | 2347649 | | 9/2000 |
| JP | 05-2954 | U | 1/1993 |
| JP | 05-16378 | A | 1/1993 |
| JP | 05-16379 | A | 1/1993 |
| JP | 10-181007 | A | 7/1998 |
| JP | 2002-19135 | | 1/2002 |
| JP | 2002-59567 | | 2/2002 |
| JP | 2002-505212 | A | 2/2002 |
| WO | 99/44830 | A | 9/1999 |
| WO | 00/26034 | A2 | 5/2000 |

OTHER PUBLICATIONS

European Search Report in appln. No. 03 00 6221.0 (Oct. 15, 2003).
Decision of Appeal, dated Sep. 30, 2008, issued in Japanese Patent Application No. 2003-77815 (and English translation thereof).

* cited by examiner

INK CARTRIDGE AND INK CARTRIDGE HOLDER

CROSS-REFERENCE TO RELATED APPLICATIONS

This application is a continuation of copending application Ser. No. 10/903,633, filed on Jul. 30, 2004, which is a division of application Ser. No. 10/391,274, filed on Mar. 18, 2003, now U.S. Pat. No. 6,832,830.

This application claims priority from Japanese patent application No. 2002-079760 filed on Mar. 20, 2002, the contents of which are incorporated herein by reference.

BACKGROUND OF THE INVENTION

1. Field of the Invention

The present invention relates to an ink cartridge and an ink cartridge holder. More particularly, the present invention relates to the ink cartridge for supplying ink to a recording apparatus, and the ink cartridge holder for holding the ink cartridge.

2. Description of Related Art

There has been known an ink jet recording apparatus including an ink cartridge holder on which an ink cartridge filled with ink is detachably mounted and for supplying the ink to the ink jet recording apparatus is known. A large-size ink cartridge is used for the ink jet recording apparatus which records on large-size papers, such as posters, in order to cope with a large quantity of ink consumption.

The ink cartridge used for the ink jet recording apparatus may be provided with an IC chip which stores information, such as a type of ink, color of ink, remaining amount of ink and the like. An information reading section is provided on the ink cartridge holder at a position facing the IC chip when the ink cartridge is mounted on the ink cartridge holder, and the IC chip on the ink cartridge and the information reading section on the ink cartridge holder are electrically connected and communicate with each other.

However, there is variation in the ink cartridge holder, the ink cartridge, their components and assembly of these components. When the relative position between the IC chip on the ink cartridge and the reading section on the ink cartridge holder deviates, the electric connection between them comes to fail and it causes communication error or interruption between them. In particular, when the size of the ink cartridge is large, the magnitude of the gap of the relative position between the IC chip and the reading section due to the product variation tends to become large.

Moreover, in order to mount the ink cartridge on the ink cartridge holder easily, there may be clearance in the ink cartridge holder. It is preferable to provide larger clearance in the ink cartridge holder for the large size ink cartridge. However, in this case, looseness due to the clearance may cause the gap of the relative position between the IC chip and the reading section, as mentioned above. Therefore, it is highly likely that the communication interruption between them will occur.

SUMMARY OF THE INVENTION

Therefore, it is an object of the present invention to provide an ink cartridge and an ink cartridge holder which can solve the foregoing problems. The above and other objects can be achieved by combinations described in the independent claims. The dependent claims define further advantageous and exemplary combinations of the present invention.

According to the first aspect of the present invention, there is provided an ink cartridge for supplying ink to a recording apparatus. The ink cartridge includes: an ink cartridge main body for containing ink therein; a connection electrode section provided on a part of a first wall of the ink cartridge main body and including connection terminals electrically connected to a memory element; an ink supply section provided in a front wall which intersects the first wall; and a positioning section for guiding the ink cartridge along a positioning member of the recording apparatus located in the vicinity of the connection electrodes on the front wall so that the positioning member opposes to the connection electrode section in the direction parallel with the connection electrode section.

In the ink cartridge, the connection electrode section is located in a recessed portion of the first wall.

In the ink cartridge, a center axis of the positioning section lies within a width of the connection electrode section.

In the ink cartridge, the center axis of the positioning section, extending in the direction parallel to the first wall and the surface perpendicular to the cartridge insertion direction, is substantially aligned with a centerline of the connection electrode section extending in the direction parallel to the first wall and the surface perpendicular to the cartridge insertion direction.

The ink cartridge may further include a substantially elliptical sub-positioning section, a center axis the sub-positioning section and said center axis of the positioning section both lying in a plane which is substantially parallel to the first wall, wherein a major axis of the sub-positioning section extends in the direction parallel to the first wall and intersects the second wall perpendicular to the cartridge insertion direction.

In the ink cartridge, a distance between the front surface and a top surface of the positioning section may be longer than a distance between the front surface and a top surface of the sub-positioning section.

The ink cartridge may further include a projecting member disposed on a second wall which intersects the first wall of the ink cartridge main body.

In the ink cartridge, viewed in a direction perpendicular to the second wall, the projection overlaps a portion of at least one of the connection electrode section and the positioning section.

The ink cartridge further includes a grip section formed at an end of the ink cartridge opposite to the front wall.

In the ink cartridge, the grip section includes a concave portion.

According to the second aspect of the present invention, there is provided an ink cartridge holder that receives an ink cartridge, where the ink cartridge is detachably mounted, where the ink cartridge has a connection electrode section for an information storing unit located on a part of a first wall, and has an ink supply section located on a front wall which intersects the first wall. The ink cartridge holder includes: a holder main body including an opening through which the ink cartridge is inserted, the front wall first, said holder main body holding the ink cartridge; an information reading section including a connection electrode section within the holder main body, the information reading section being provided in a position corresponding to the connection electrode section of the information storing unit of the ink cartridge so that, when the ink cartridge is mounted, the connection electrode section of the information reading section is in electrical contact with the connection electrode section of the ink cartridge; and a positioning member extending from the holder main body toward the opening face, and positioned in the vicinity of the information reading section in a direction parallel with the first wall and with the front wall of the ink cartridge so that, viewed in a direction perpendicular to a plane in which the first wall of the ink cartridge lies, when the ink cartridge is mounted, at least a portion of the positioning member overlaps at least a portion of the information reading section of the ink cartridge.

In the ink cartridge holder, the positioning member may include: a positioning member main body having a tapered end, the positioning member main body being dimensioned and disposed so that when the ink cartridge is held by the holder main body, the positioning member main body is received by the ink cartridge; and an abutting section including an abutment surface which abuts against the ink cartridge when the ink cartridge is held by the holder main body.

In the ink cartridge holder, the abutting section has a larger cross-sectional area than a cross-sectional area of the positioning member main body.

In the ink cartridge holder, viewed in a direction perpendicular to the first wall of a mounted ink cartridge, a center axis of the positioning member main body lies within the width of the connection electrode section of the information reading section.

In the ink cartridge holder, the center axis of the positioning member main body extending in a same direction as the positioning member may be substantially aligned with a centerline of the connection electrode section of the information reading section extending in the direction parallel to the first wall and intersecting the front wall of the ink cartridge.

The ink cartridge holder may further include a sub-positioning member extending from the holder main body toward the opening face of the holder, the sub-positioning section and the positioning member both lying in a plane which is substantially parallel to the first wall, wherein the distance between the connection electrode section of the information reading section and the sub-positioning member is longer than the distance between the connection electrode section and the positioning member in a direction parallel to the first wall and the front wall of the ink cartridge.

In the ink cartridge holder, a center axis of the positioning member is parallel to a center axis of the sub-positioning member.

In the ink cartridge holder, the sub-positioning member may include: a sub-positioning member main body with a tapered end, the sub-positioning member main body being dimensioned and disposed so that when the ink cartridge is held by the holder main body, the sub-positioning member main body is received by the ink cartridge; and an abutting section with larger cross-sectional area than the sub-positioning member main body including an abutment surface, wherein a distance between the opening face and the abutment surface of the abutting section of the sub-positioning member is greater than a distance between the opening face and the abutment surface of the abutting section of the positioning member.

In the ink cartridge holder, the holder main body is dimensioned so that there is at least clearance at least in the direction parallel to the first wall and the front wall of the ink cartridge during the mounting of the ink cartridge.

The ink cartridge holder may further include an urging section selectively pressing against the second wall which intersects the first wall and the front wall of the ink cartridge.

In the ink cartridge holder, the urging section has a first position in which the ink cartridge can be inserted into and removed from the holder main body, and a second position in which the ink cartridge is restrained in the holder main body.

The summary of the invention does not necessarily describe all necessary features of the present invention. The present invention may also be a sub-combination of the features described above.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
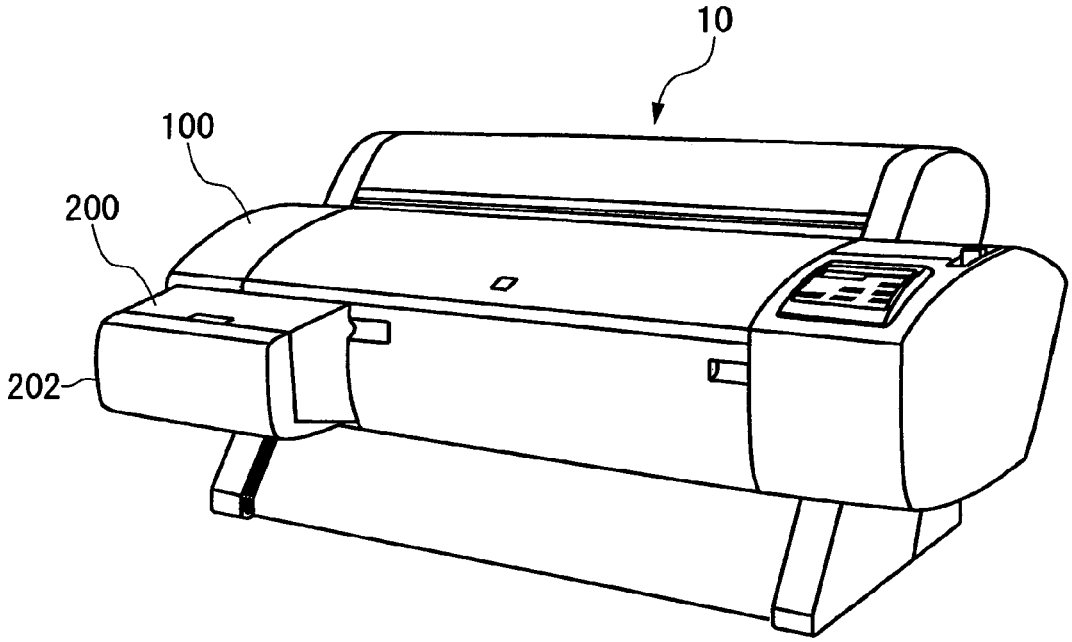
FIG. 1 is a perspective view of an ink jet recording apparatus according to a first embodiment of the present invention.

FIG. 1 is a perspective view of an ink jet recording apparatus 10 according to a first embodiment of the present invention. The ink jet recording apparatus 10 includes a recording apparatus main body 100, and an ink cartridge holder 200 which is provided in a part of the recording apparatus main body 100 and to which the ink cartridge is mounted. The ink cartridge holder 200 of the ink jet recording apparatus 10 includes the pivotable cover 202. An example of the ink jet recording apparatus 10 is a large-size ink jet printer which records on large-size papers or other mediums of A2 to A0 size, for example, such as posters, requiring large quantity of ink.

Figure 2:
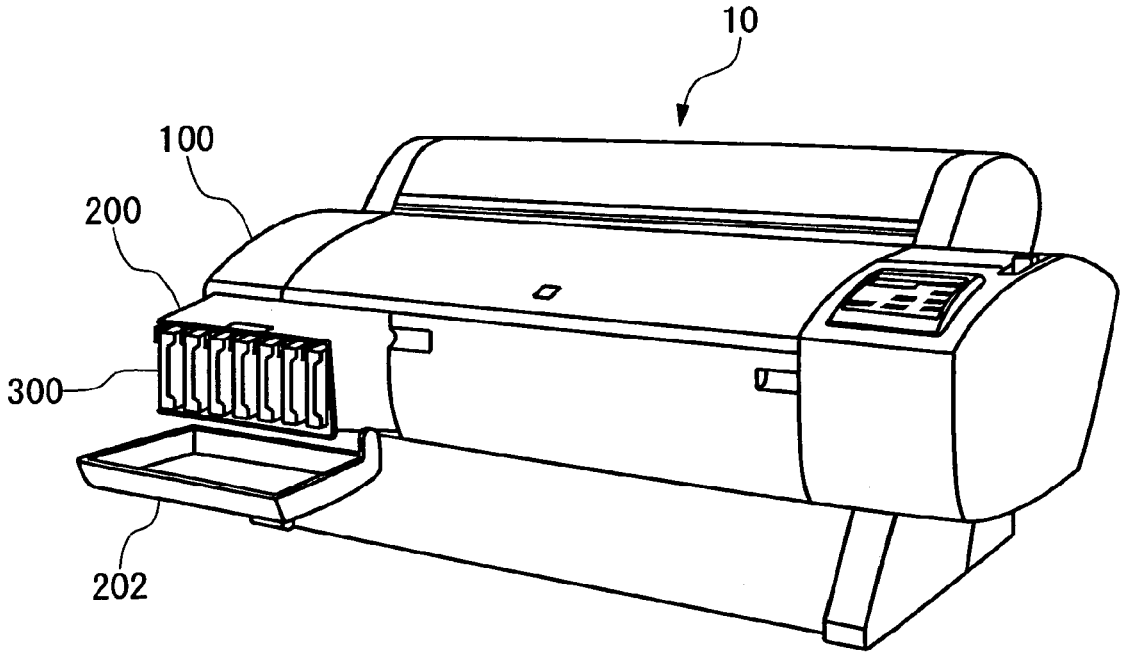
FIG. 2 is a perspective view of the ink jet recording apparatus shown in FIG. 1 with a cover of the ink cartridge holder being open.

FIG. 2 is a perspective view of the ink jet recording apparatus 10 shown in FIG. 1 with the cover 202 of the ink cartridge holder 200 being open. The ink cartridge holder 200 holds a plurality of ink cartridges 300. The ink jet recording apparatus 10 is equipped with a plurality of ink cartridges 300, where each of the ink cartridges 300 is filled with ink of a predetermined color respectively. Accordingly, the ink jet recording apparatus 10 records color image on the supplied papers.

Figure 3:
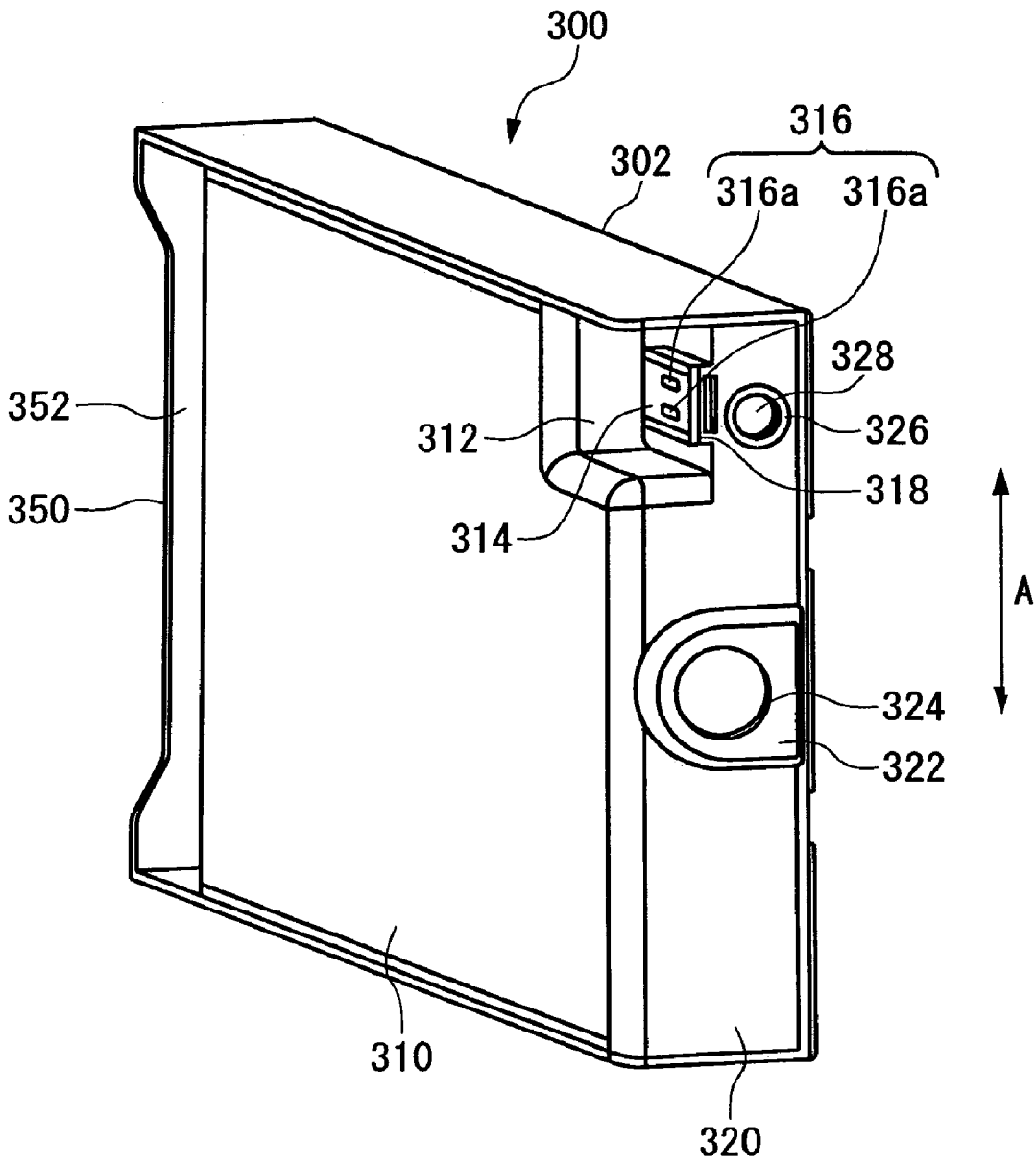
FIG. 3 is a front perspective view of an ink cartridge according to the first embodiment.

FIG. 3 is a front perspective view of the ink cartridge according to the first embodiment of the present invention. The ink cartridge 300 according to the first embodiment includes an ink cartridge main body 302 having a substantially rectangular parallelepiped shape, an information storing unit 314 provided on a recess 312 which is a part of a first side or a first wall 310 of the ink cartridge main body 302, an ink supply unit 322 provided on the front surface 320, which is perpendicular to the first wall 310, and a positioning section 326 provided on the front surface 320.

Figure 23:
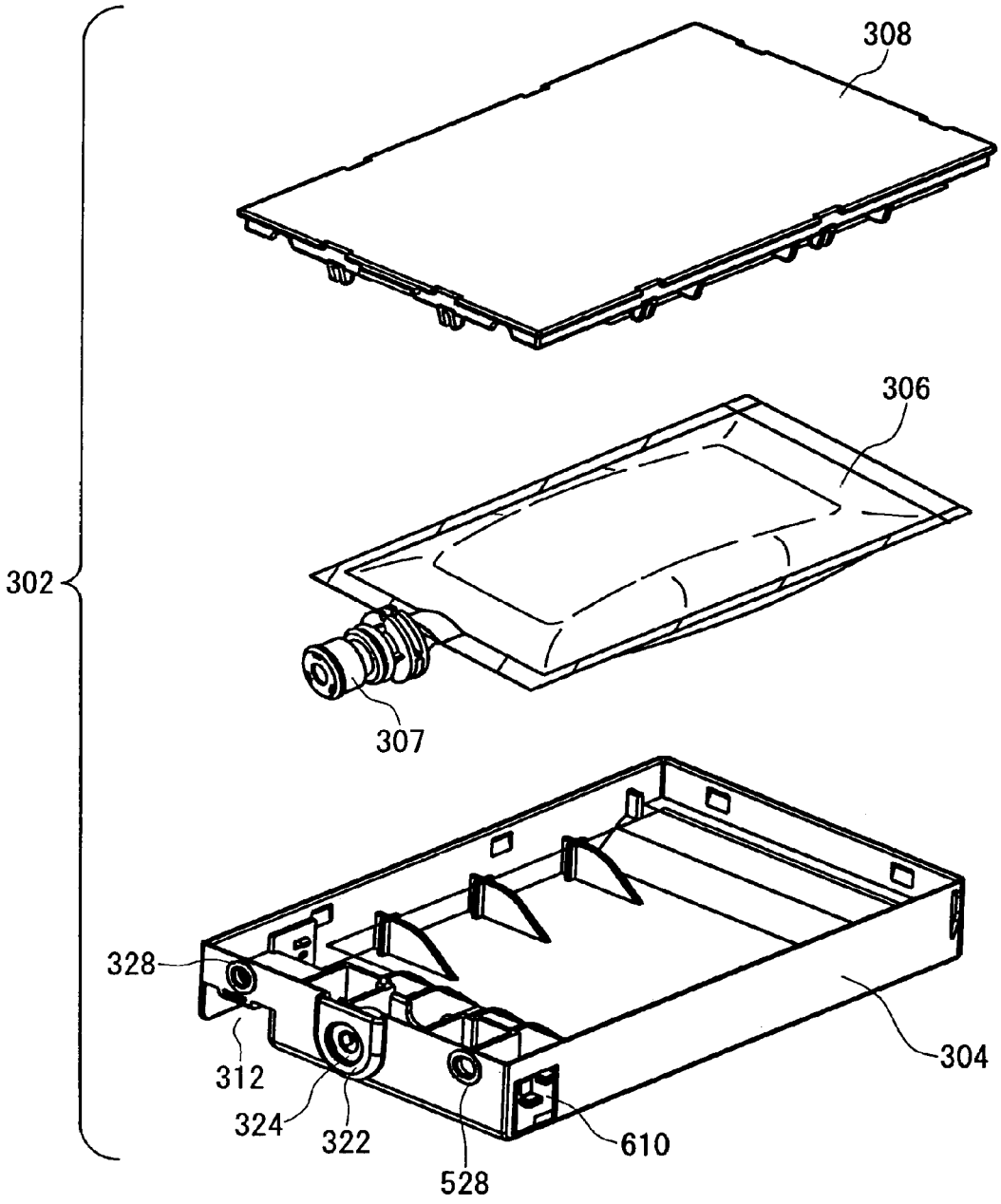
FIG. 23 is an exploded perspective view of the ink cartridge main body.

FIG. 23 is an exploded perspective view of the ink cartridge main body 320. The ink cartridge main body 302 of the ink cartridge 300 contains ink therein. As an example of an ink holding means inside the ink cartridge main body 302, the ink cartridge main body 302 includes a container main part 304 with one side being open, a flexible bag 306 to which an ink supply port 307 is provided at one end, and a substantially flat-plated cover unit 308. In this ink cartridge main body 302, the bag 306 is filled up with ink, the bag 306 is enclosed in the ink cartridge main body 302, and the ink supply port 307 provided at one end of it is fixed to the ink supply unit 322. The cover unit 308 is fixed to an opening of the container main part 304 by vibration welding or the like, with the bag 306 being enclosed. Thereby, a large quantity of ink is held and the large quantity of the ink is supplied to the ink jet recording apparatus stably which records on large size papers such as posters.

Figure 4A:
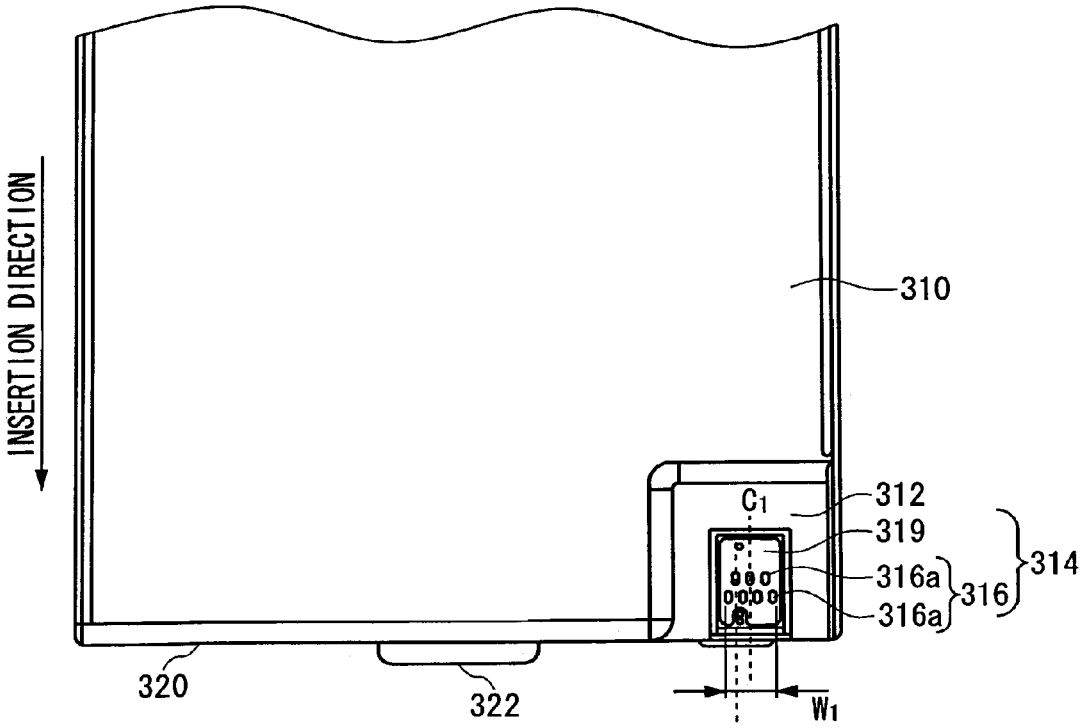
FIG. 4 is plane views of the ink cartridge according to the first embodiment.

The information storing unit 314 of the ink cartridge 300 stores information, such as a type of ink and the ink cartridge, color of the ink in the ink cartridge, and remaining amount of the ink. For example, as shown in FIG. 4A, the information storing unit 314 is a contact type IC chip. The contact type IC chip includes a substrate 319, a connection electrode section 316 including a plurality of connection terminals 316*a* which are exposed to the front surface of the substrate 319, and memory including a semiconductor memory element, such as EEPROM provided on a back side of the substrate 319. The information data in the memory is read or rewritten through the connection terminals 316*a* electrically connecting with connection electrodes of the recording apparatus. In the present embodiment, the information storing unit 314 is of a contact type which is provided with the connection electrode section 316 including the plurality of connection terminals 316*a* exposed outside.

Figure 4B:
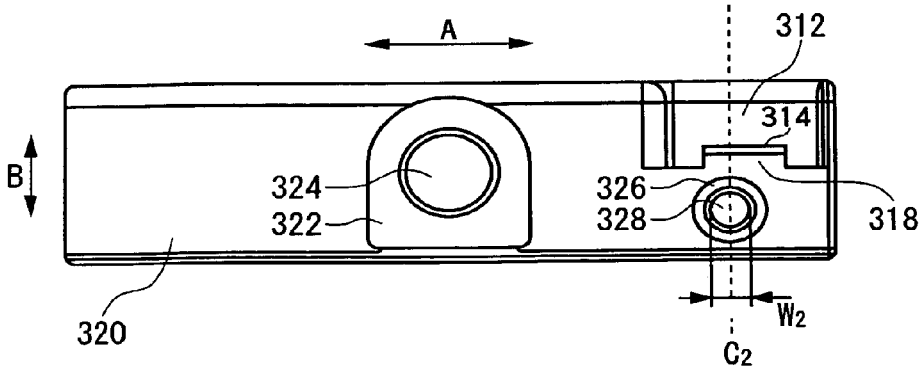

Although two connection terminals 316*a* are illustrated in FIG. 3 for clearness, seven connection terminals are arranged in two rows staggeredly in the present embodiment as shown in FIG. 4. Alternatively, for example, the memory of the information storing unit may be provided on the other wall of the cartridge main body or the like and connects with the connection electrode section 317, which is provided on the first wall 310, via a flexible print circuit (FPC). Furthermore, the information storing unit is not limited to contact type but a non-contact type information storing unit using magnetism or optics is applicable.

In the present embodiment, the recess 312 is provided in upper part of the first wall 310 of the ink cartridge main body 302 as shown in FIG. 3. The information storing unit 314 and especially the connection electrode section 316 are arranged in the recess 312. The recess 312 prevents careless contact or impact to the information storing unit 314 from outside. Moreover, since the upper part of the connection terminal surface is opened to the outside in the recess 312, the information storing unit 314 is easily mounted on the ink cartridge main body 302 during manufacturing of the ink cartridge.

In addition, the bottom of the recess 312 and top surface (surface on which the connection electrode section is provided) of an information storing unit attachment unit 318 which projects from the recess 312 are provided substantially parallel to the first wall 310.

An ink supply port 324 is provided in the ink supply section 322 of the ink cartridge 300, and the ink is supplied to the recording apparatus main body 100 from the ink cartridge 300 through the ink supply port 324. In addition, according to an embodiment which includes the ink bag having the ink supply port at one end as shown in FIG. 23, one end of the ink supply port 307 of the ink bag is fixed so that it exposes from the ink supply port 324, and an ink supply needle of the recording apparatus is inserted in the ink supply port 307. For example, the ink supply port 307 of the ink bag 306 is sealed by elastic member, such as rubber, so as to prevent leakage of the ink. Alternatively, a valve, which can be opened by insertion of the ink supply needle, may be provided.

Furthermore, in the rear side of the ink cartridge 300, there includes a grip 350 and a hollow 352. The grip 350 and the hollow 352 enable a user to securely grip the ink cartridge 300, and to easily attach/detach the ink cartridge 300 to/from the ink cartridge holder 200 of the ink jet recording apparatus 10.

FIG. 4 shows a part of the cartridge viewed from the front and from the first wall of the ink cartridge according to the first embodiment. The positioning section 326 of the ink cartridge 300 is provided in the vicinity of the connection electrode section 316 of the information storing unit 314 provided in the recess 312 of the first wall 310 so that it overlaps with the connection electrode section 316 in the direction of the cartridge thickness viewed from the front surface (the direction of arrow B). More particularly, the positioning section 326 positions so that the center line of the width W2 of a port 328 of the positioning section 326 is located within the range of the width W1 of the connection electrode section 316 in the direction of arrow A. The arrow A in the drawing shows "direction parallel to the first wall and a surface perpendicular to the cartridge installation direction". In other words, the port 328 of the positioning section 326 extends in a direction in which the ink cartridge is mounted and the center axis of the port 328 is located within a range of the width W1 of the connection electrode section 316 when viewed in the direction perpendicular to the first wall 310.

Moreover, although the shape of the positioning section 326 may be a concave or cylindrical shape so that a below-mentioned positioning member 220 is inserted into it, it is preferable that the positioning section 326 is shaped so as to limit the movement of the cartridge in the direction of the arrow A, and/or the direction of the arrow B, which is perpendicular to the direction of the arrow A as shown in the drawing.

As for the port 328 of the positioning section 326, it is preferable that the center line C2 of the width W2 of the port 328 of the positioning section 326 in the direction of the arrow A is substantially aligned with the center line C1 of the width W1 of the connection electrode section.

More particularly, in FIG. 4, it is preferable that a center line C2 in the direction of the first wall, which passes through the center axis of the width W2 of the port 328 of the positioning section 326, and a center line C1 of the connection electrode section 316 on the information storing unit 314, are aligned in the direction of the arrow A, which is parallel to the first wall 310 in the drawing and the front surface 320. Thereby, the connection electrode section is accurately aligned with the connection electrodes of the recording apparatus when the cartridge is installed to a below-mentioned ink cartridge holder.

Figure 5:
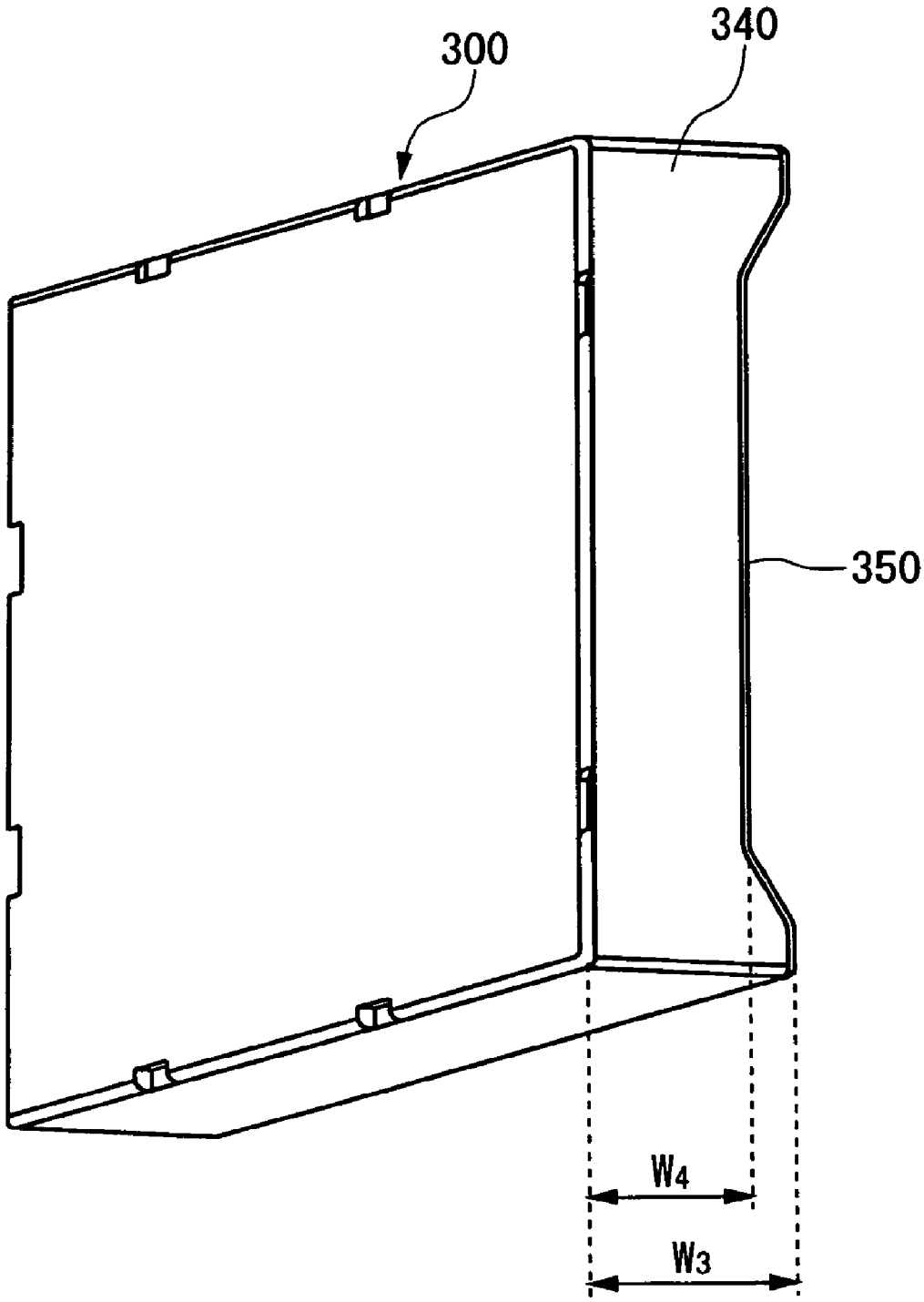
FIG. 5 is a rear perspective view of the ink cartridge according to the first embodiment.

FIG. 5 is a rear perspective view of the ink cartridge according to the first embodiment. The ink cartridge 300 includes a rear surface 340, which is substantially parallel to the front surface 320. The grip 350 is provided on the rear surface 340, and a width W4 of the grip is narrowly shaped compared with the maximum width W3 of the rear surface. Therefore, even if the plurality of installed cartridge adjoin each other in the cartridge holder as shown in FIG. 1, the ink cartridges can be taken out easily by inserting user's finger into the grip.

Figure 6:
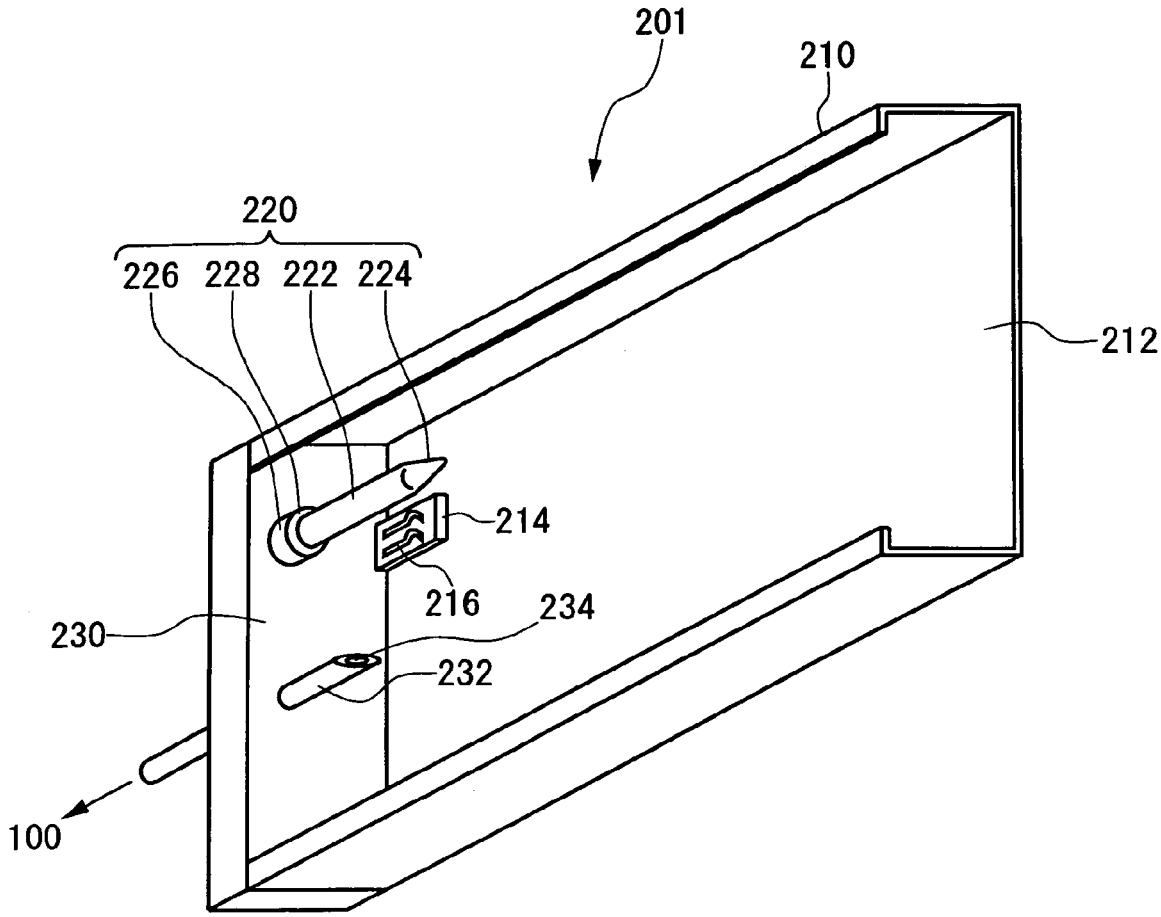
FIG. 6 is a partial perspective view of the ink cartridge holder according to the first embodiment.

FIG. 6 is a partial perspective view of the ink cartridge holder of the first embodiment. Although the ink cartridge holder 200 of FIG. 1 holds the plurality of ink cartridges, one ink cartridge holder 201 holding one of the ink cartridges is shown here for explanation.

The ink cartridge holder 201 according to the first embodiment includes a main part 210 which has an opening face 212 through which the ink cartridge 300 is installed from the front surface 320, and holds the ink cartridge 300. In the present embodiment, the ink cartridge holder 201 includes an end face 230 which is substantially parallel to the opening face 212.

Furthermore, in the inner side of a holder main body 210 of the ink cartridge holder 201, an information reading section 214 is provided at the position corresponding to the information storing unit 314 of the ink cartridge 300. A plurality of connection electrodes 216 corresponding to the plurality of connection terminals 316*a* of the connection electrode section 316 of the ink cartridge 300 are provided on the top surface of the information reading section 214. Although only two connection electrodes are illustrated in the drawing for clearness, the configuration of the information reading section 214 is not limited to the above-mentioned embodiment shown in the drawing as long as it reads information in the information storing unit 314 of the ink cartridge 300.

Furthermore, the ink cartridge holder 201 includes the positioning member 220 which extends to the direction of the opening face 212 from the holder main body 210. According to the present embodiment, the positioning member 220 has a substantially tubular shape with a circular cross-sectional shape corresponding to the port 328 of the positioning section 326 of the ink cartridge 300. The positioning member 220 includes a tapered conical end 224, and includes a positioning member main body 222 which is inserted in the port 328 of the ink cartridge 300. Furthermore, the positioning member 220 includes an abutting section 226 having an abutment surface 228 abutting on the ink cartridge 300, where cross-sectional area of the abutting section 226 is larger than that of the positioning member main body 222. In the present embodiment, the abutting section 226 extends from the end face 230.

The ink cartridge holder 201 further includes an ink supply needle 232, where an end of the ink supply needle 232 is connected to a recording head of the recording apparatus main body 100. The ink supply needle 232 includes an ink passage 234, connects with the ink supply unit 322 of the ink cartridge, and supplies the ink in the ink cartridge 300 to the recording head provided in the recording apparatus main body 100.

Figure 7:
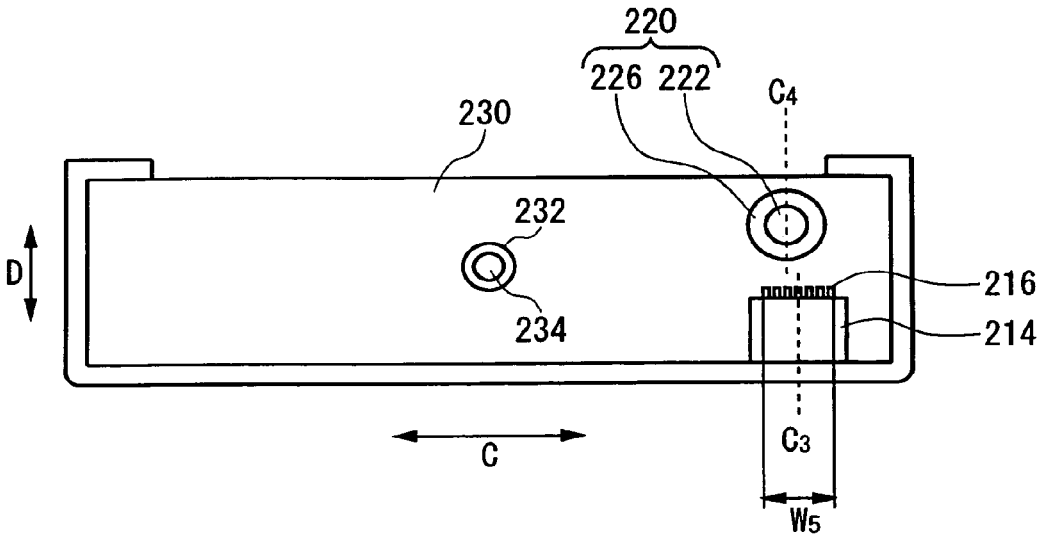
FIG. 7 is a partial front view of the ink cartridge holder according to the first embodiment.

FIG. 7 is a partial front view of the ink cartridge holder 201 according to the first embodiment viewed from the opening face.

The positioning member 220 of the ink cartridge holder 201 is in the vicinity of the connection electrode 216 of the information reading section 214, and provided so that it opposes to the connection electrode section 316 in the direction of arrow D (thickness direction of the installed cartridge). Moreover, the direction of arrow C in the drawing shows the direction parallel with the first wall 310 of the installed ink cartridge 300 and a surface perpendicular to the installation direction of the cartridge.

The positioning member 220 is provided so that a center line C4, which passes through the center axis of the extending direction of the positioning member main body 222, is positioned within range of width W5 of the connection electrode 216 of the information reading section 214 in the direction of an arrow C. Furthermore, it is preferable that the center line C4, which passes through the center axis of the extending direction of the positioning member main body 222, is aligned with a center line C3, which passes through center axis of width W5 of the connection electrode 216 of the information reading section 214 in the direction of the arrow A. In other words, the main body 222 of the positioning member 220 extends in a direction to which the ink cartridge is mounted and the center axis of the main body 222 is located within a range of the width W5 of the information reading section 214 when viewed in the direction perpendicular to the first wall 310.

Figure 8:
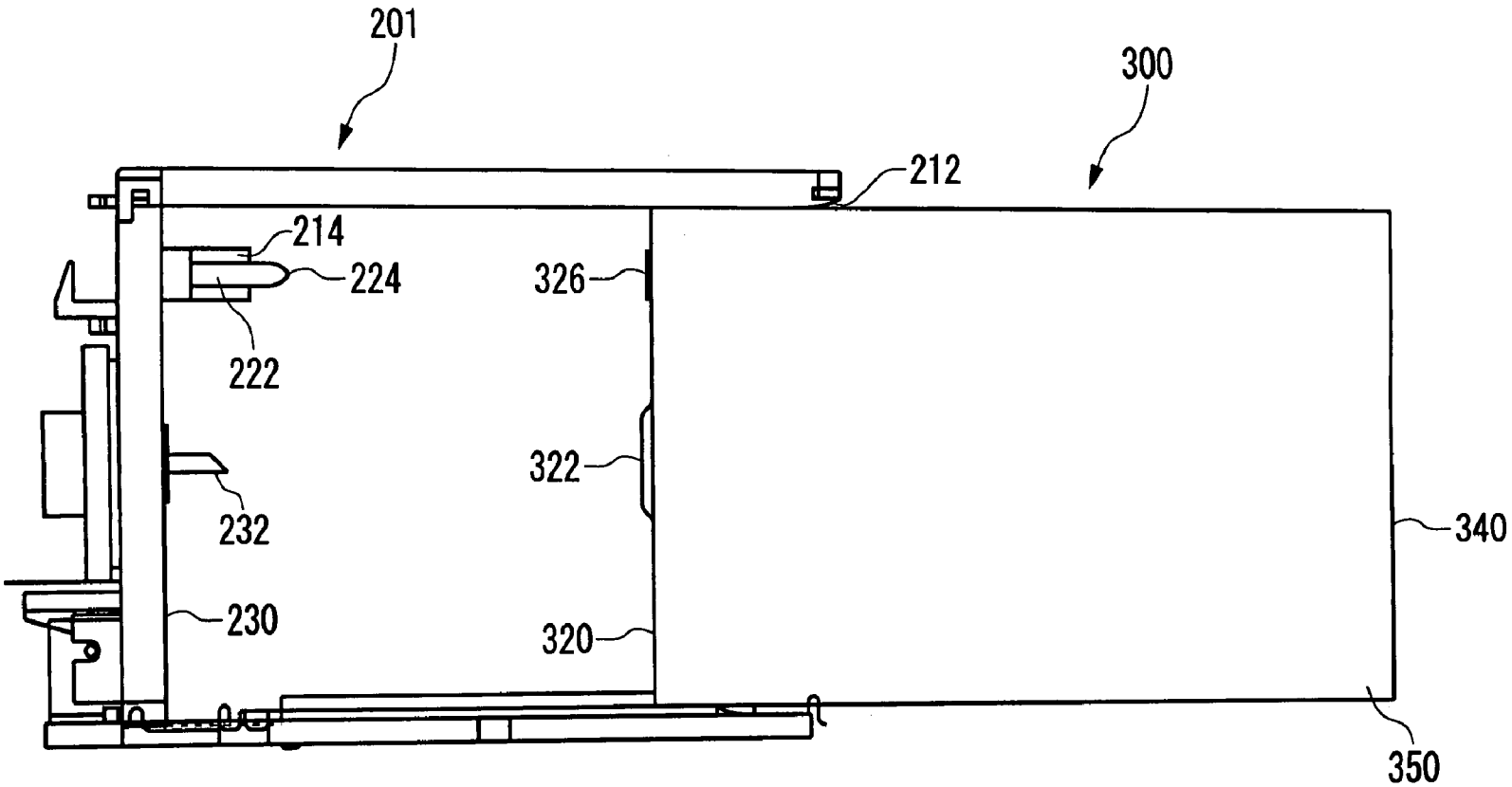
FIG. 8 is a partial side view showing process of ink cartridge installation to the ink cartridge holder according to the first embodiment.
Figure 9:
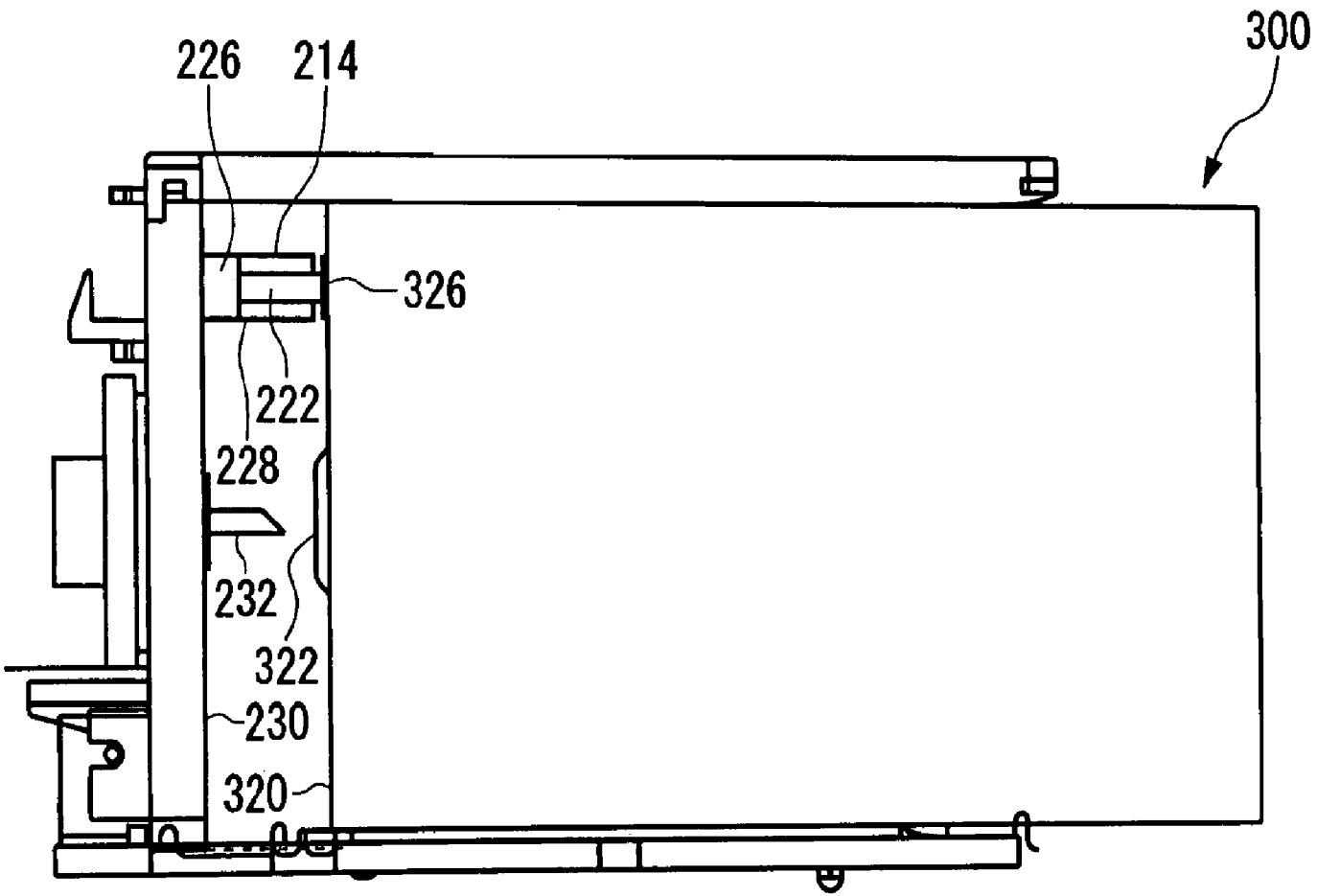
FIG. 9 is a partial side view showing process of the ink cartridge installation to the ink cartridge holder according to the first embodiment.
Figure 10:
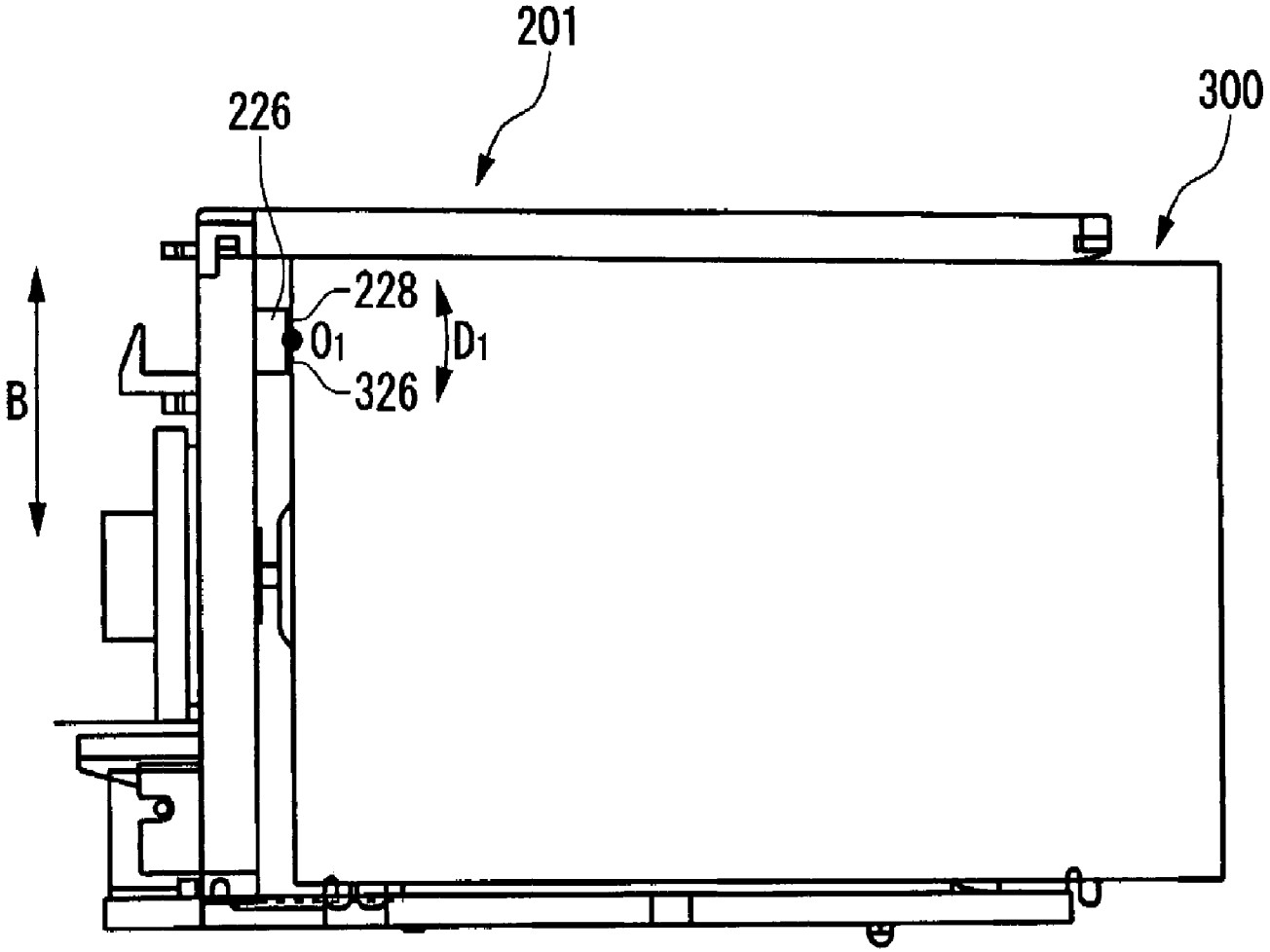
FIG. 10 is a partial side view showing process of the ink cartridge installation to the ink cartridge holder according to the first embodiment.

FIGS. 8-10 are partial side views showing process of ink cartridge installation to the ink cartridge holder according to the first embodiment.

FIG. 8 is a partial side view showing first step of the installation of the ink cartridge 300 to the ink cartridge holder 201. The front surface 320 of the ink cartridge 300 is inserted from the opening face 212 of the holder main body 210 of the ink cartridge holder 201. At this time, the end 224 of the positioning member 220 of the ink cartridge holder 201 opposes to the port 328 of the positioning section 326 of the ink cartridge 300. Furthermore, the ink supply needle 232 of the ink cartridge holder 201 opposes to the ink supply port 324 of the ink supply unit 322 of the ink cartridge 300. Then, the ink cartridge 300 is further inserted into the ink cartridge holder 201 more deeply.

FIG. 9 is a partial side view showing next step of the ink cartridge installation following FIG. 8. When the ink cartridge 300 is further inserted into the ink cartridge holder 201 more deeply than the state shown in FIG. 8, the end 224 of the positioning member 220 of the ink cartridge holder 201 is inserted in the port 328 of the positioning section 326 of the ink cartridge 300. Since the end 224 is tapered towards the nose from the positioning member main body 222, a position gap between the ink cartridge holder 201 and the ink cartridge 300 is compensated, so that the ink cartridge 300 is guided into the ink cartridge holder 201.

When the ink cartridge 300 is further inserted into the ink cartridge holder 201 much more deeply, the ink supply needle 232 of the ink cartridge holder 201 is inserted into the ink supply port 324 of the ink supply unit 322 of the ink cartridge 300.

FIG. 10 is a partial side view showing the next step of the ink cartridge installation following FIG. 9. When the ink cartridge 300 is further inserted into the ink cartridge holder 200 more deeply than the state shown in FIG. 9, the positioning section 326 of the ink cartridge 300 abuts on the abutment surface 228 of the abutting section 226 of the positioning member 220 in the ink cartridge holder 201. Thereby, the insertion of the ink cartridge 300 into the ink cartridge holder 201 is completed. Although it is not shown in the drawings, the connection electrodes 216 of the information reading section 214 in the ink cartridge holder 201 respectively contact with connection terminals 316*a* of the connection electrode section 316 of the information storing unit 314 in the ink cartridge 300.

Accordingly, installation of the ink cartridge 300 to the ink cartridge holder 201 is completed. The information reading section 214 of the ink cartridge holder 201 reads information such as a kind of ink cartridge, color of the ink which the ink cartridge is holding, and the remaining amount of the ink, from the information storing unit 314 of the ink cartridge 300. Based on the read information and demand from the recording apparatus main body 100, the ink in the ink cartridge 300 is supplied to the recording apparatus main body 100 through the ink supply needle 232 of the ink cartridge holder 201. The ink jet recording apparatus 10 records on papers using the supplied ink. Moreover, in accordance with the amount of the ink used for the recording, the information reading section 214 of the ink cartridge holder 201 writes information, such as remaining amount of the ink in an ink cartridge at this moment, to the information storing unit 314 of the ink cartridge.

There is variation in the ink cartridge holder 201, the ink cartridge 300, their components and assembly of these components. Due to such variations, the ink cartridge 300 may be installed in the ink cartridge holder 201 in the direction of the arrow B in FIG. 10. Even if it is that case, since the positioning member 220 of the ink cartridge holder 201 and the positioning section 326 of the ink cartridge 300 are engaged, the ink cartridge 300 rotates in the ink cartridge holder 201 in the direction of arrow D1 substantially on a point O1. Therefore, even if there is the instability, a gap of relative position between the connection electrode 216 on the information reading section 214 of the ink cartridge holder 201 and the connection electrode section 316 on the information storing unit 314 of an ink cartridge 300, which should be aligned accurately, is very little.

As mentioned above, according to the first embodiment, even if the ink cartridge has the instability to the ink cartridge holder due to the variation in every product or the like, the connection electrodes on the information reading section of the ink cartridge holder are aligned with the connection terminals on the information storing unit of the ink cartridge, where accurate positioning is required.

Figure 11:
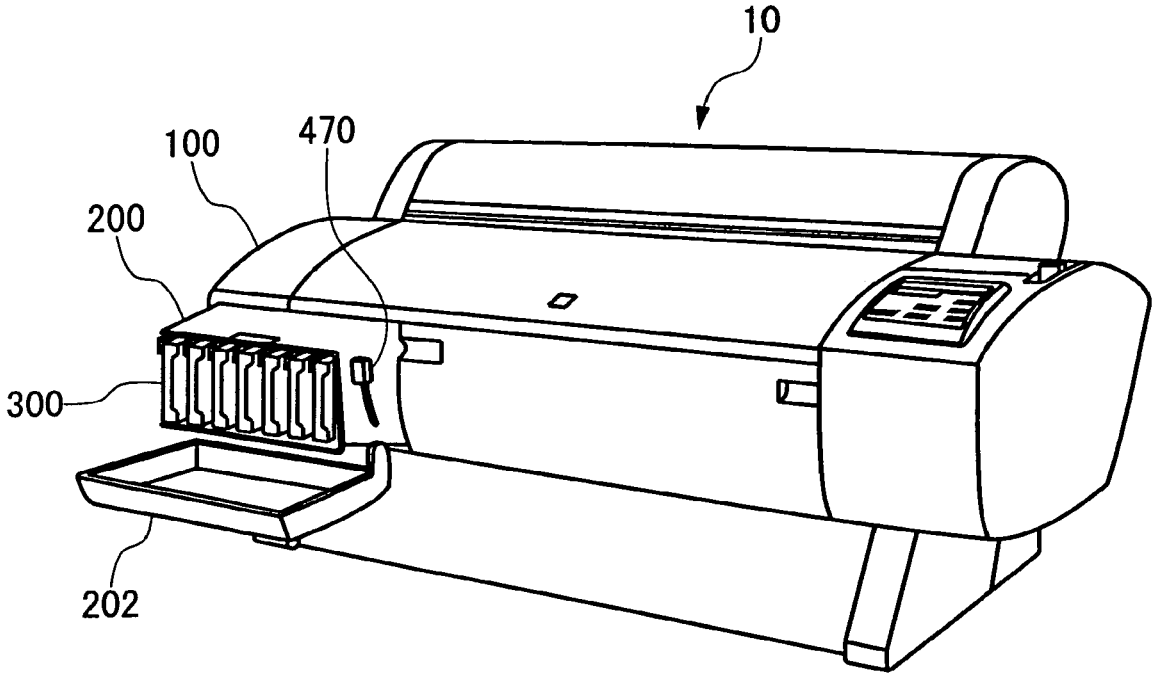
FIG. 11 is a perspective view of the ink jet recording apparatus according to a second embodiment with a cover of the ink cartridge holder being open.

FIG. 11 is a perspective view of the ink jet recording apparatus according to a second embodiment with a cover 202 of the ink cartridge holder 200 being open. A lever 470 is provided on the right of the ink cartridge holder 200 of the ink jet recording apparatus 10, and when this lever 470 is moved up and down, the ink cartridge 500 is locked or unlocked.

Figure 12:
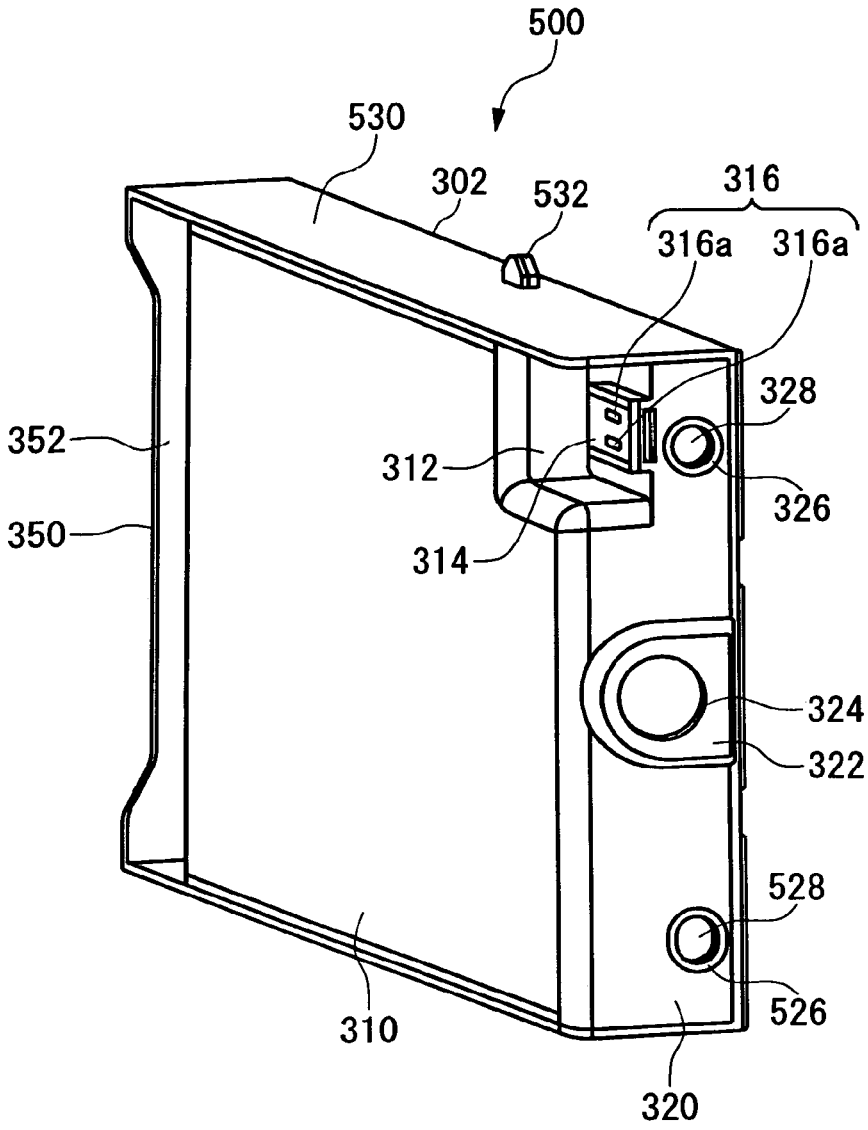
FIG. 12 is a front perspective view of the ink cartridge according to the second embodiment of the present invention.

FIG. 12 is a front perspective view of the ink cartridge according to the second embodiment of the present invention. In the ink cartridge 500 according to the second embodiment, the same reference numeral is given to the same component as that of the ink cartridge 300 of the first embodiment, and explanation of the component is omitted. The ink cartridges 500 according to the second embodiment differs with the ink cartridge 300 according to the first embodiment, in that it further includes a sub-positioning section 526. The ink cartridge 500 further includes a projection 532 on a 2nd side 530 which intersects the first wall 310 and the front surface 320 of the ink cartridge main body 302.

Figure 13A:
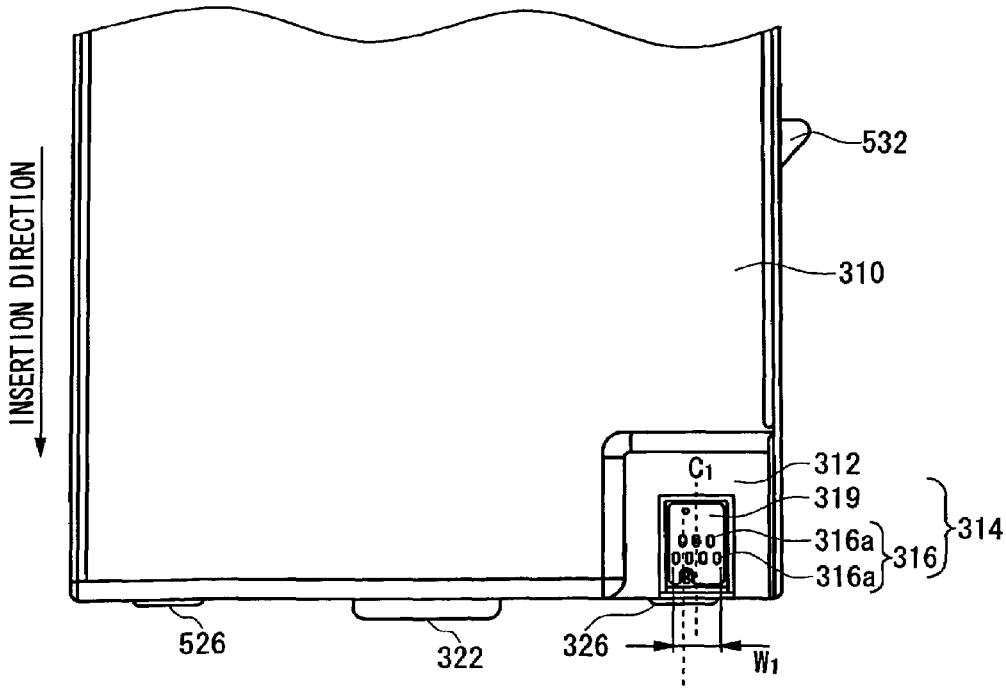
FIG. 13 is plain views of the ink cartridge according to the second embodiment.
Figure 13B:
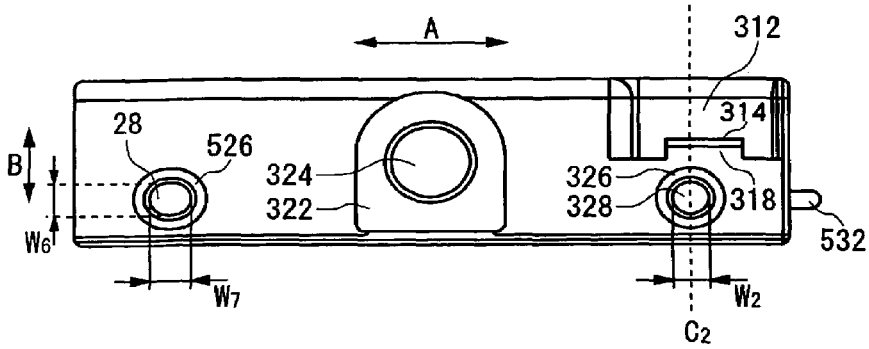

FIG. 13 shows a part of the cartridge according to the second embodiment viewed from the front and the first wall of the ink cartridge. The sub-positioning section 526 and the positioning section 326 are arranged in parallel in the direction A in the drawing (the direction parallel with the first wall 310 and a surface perpendicular to the cartridge installation direction) so that the ink supply unit 322 is positioned between them, and the sub-positioning section 526 is located farther from the connection electrode section 316 of the information storing unit 314 than the positioning section 326. The sub-positioning section 526 includes an elliptical port 528, where width W7 of a major axis in the direction of arrow A is longer than width W6 of a minor axis in the direction of arrow B. In the present embodiment, surface of the sub-positioning section 526 and surface of the positioning section 326 are substantially in one plane. As shown in FIG. 13, both the center axes of the sub-positioning section 526 and the positioning section 326 extend substantially in parallel to the first wall 310.

Figure 14:
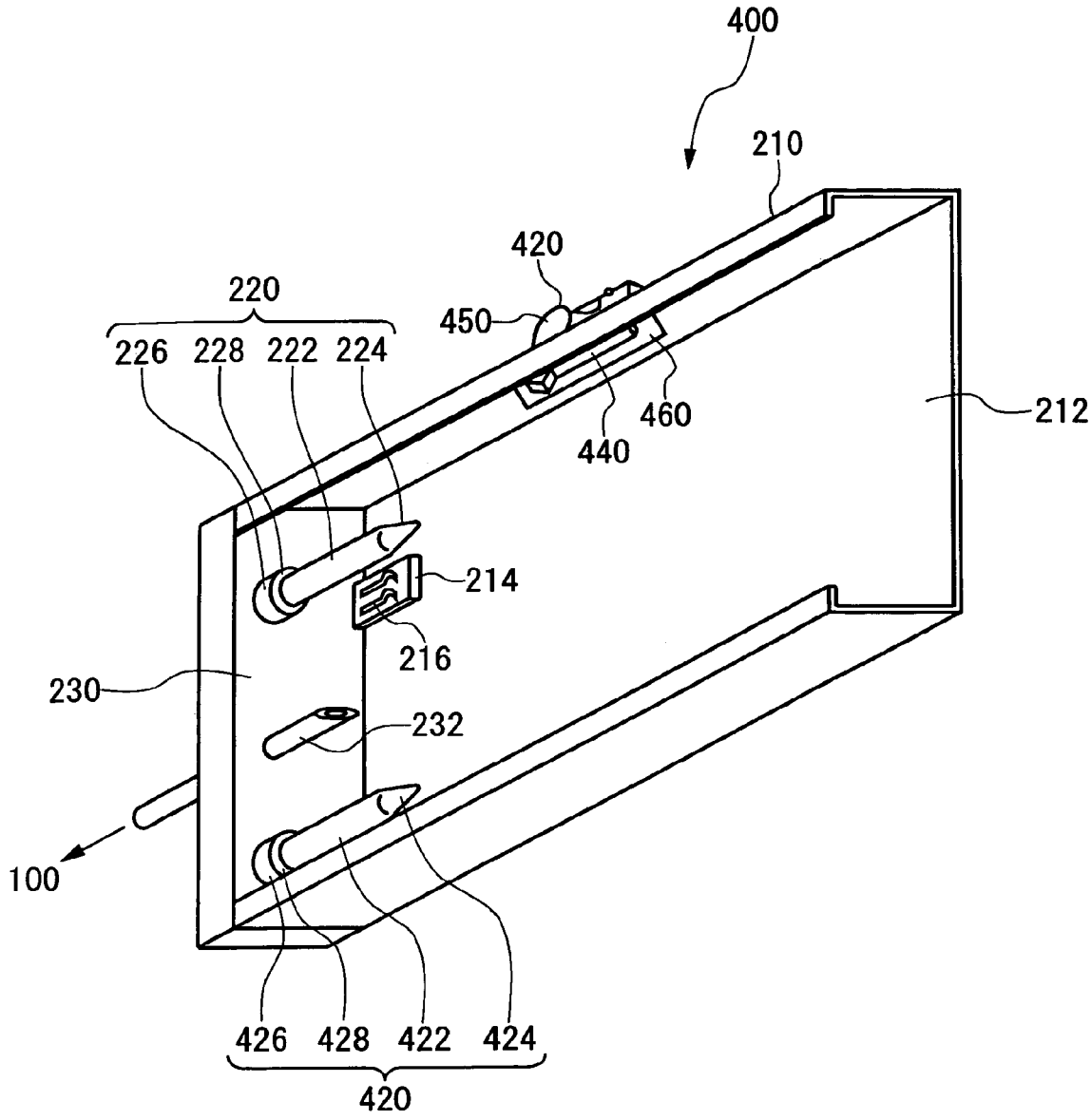
FIG. 14 is a partial perspective view of the ink cartridge holder according to the second embodiment.
Figure 15:
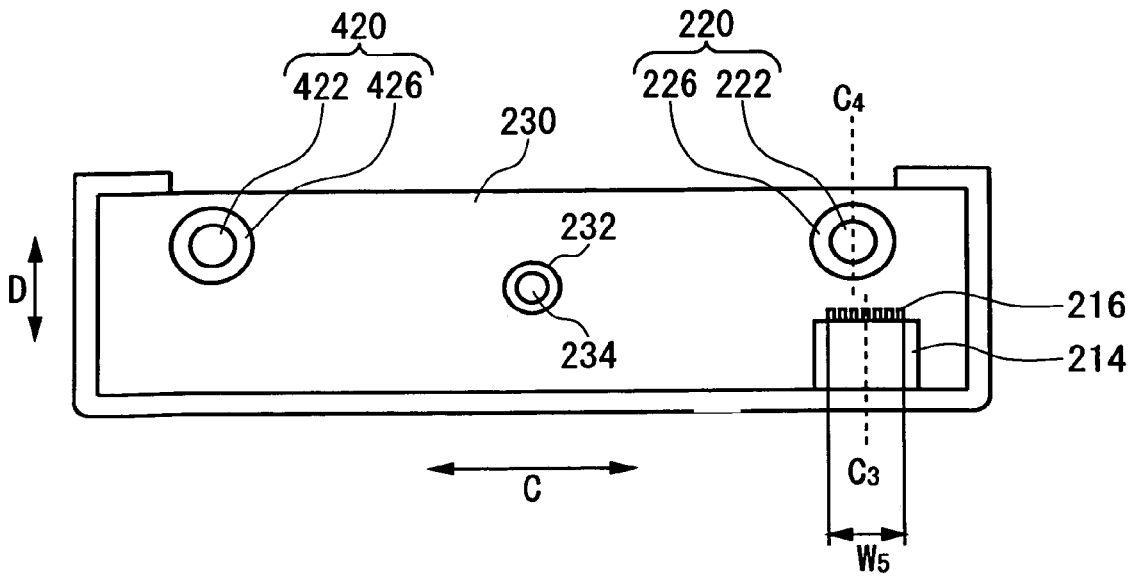
FIG. 15 is a partial front view of the ink cartridge holder according to the second embodiment.

FIG. 14 is a partial perspective view of an ink cartridge holder 400 according to the second embodiment. FIG. 15 is a partial front view of the ink cartridge holder 400 according to the second embodiment. In the ink cartridge holder 400 according to the second embodiment, the same reference numeral is given to the same component as that of the ink cartridge holder 201 according to the first embodiment, and explanation of the component is omitted. The ink cartridge holder 400 according to the second embodiment differs with the ink cartridge holder 201 according to the 1st embodiment in that it further includes a sub-positioning member 420.

The sub-positioning member 420 of the ink cartridge holder 400 extends from the holder main body 210 to the direction of the opening face 212. The sub-positioning member 420 is provided in parallel with the positioning member 220 in the direction of arrow C in the drawing so that the ink supply needle 232 is positioned between them. The sub-positioning member 420 is located in a position distant from the connection electrode section 216 of the information reading section 214.

Figure 16:
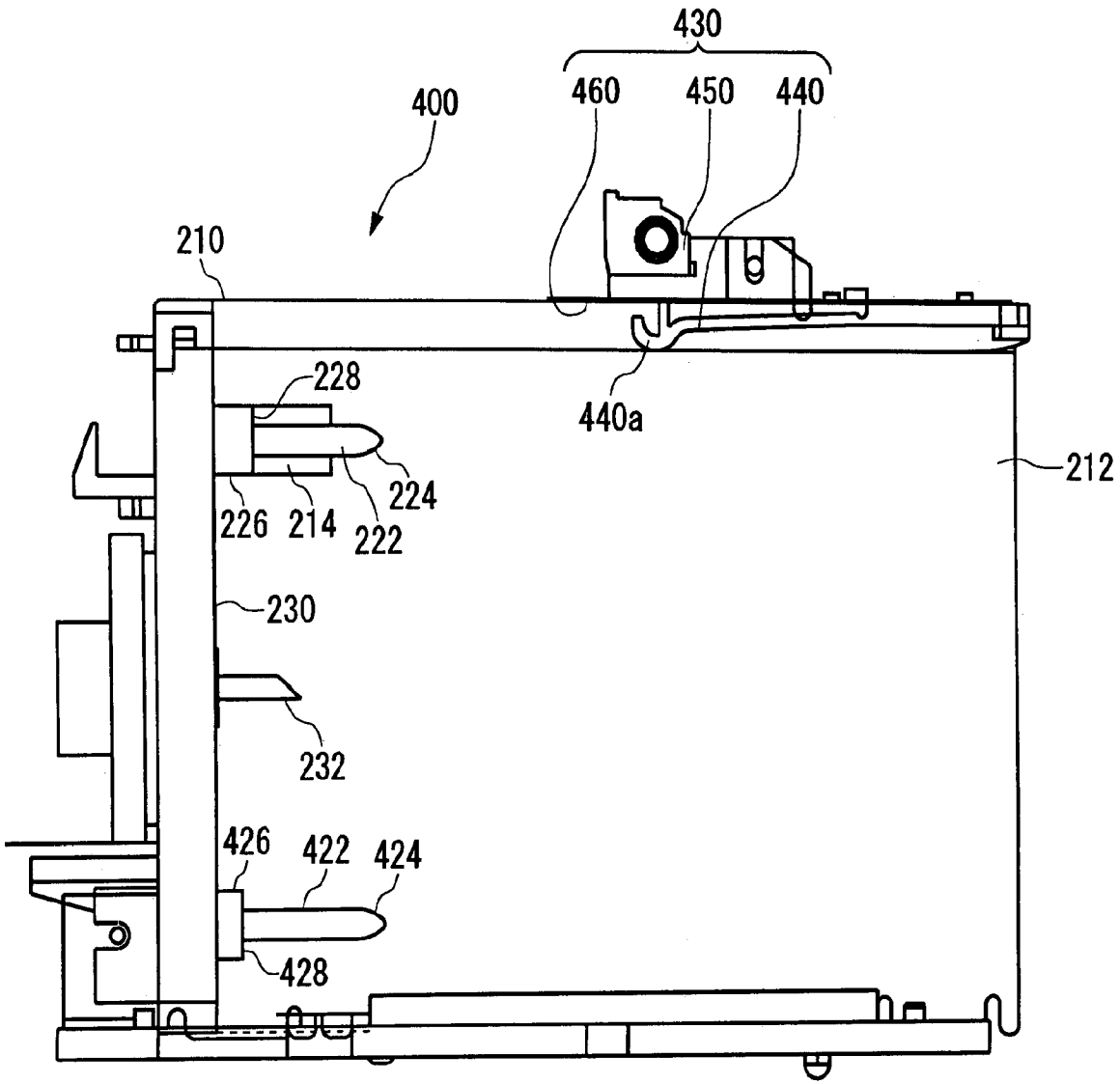
FIG. 16 is a partial side view of the ink cartridge holder according to the second embodiment.

FIG. 16 is a partial side view of the ink cartridge holder according to the second embodiment. The sub-positioning member 420 includes a positioning-member main body 422 having a tapered conical end 424, which is inserted into the ink cartridge 500. The sub-positioning member 420 further includes an abutting section 426 having an abutment surface 428, where distance between the abutment surface 428 and the opening face 212 is longer than the distance between the abutment surface 228 of the abutting section 226 of the positioning member 220 and the opening face 212. A cross-sectional area of the abutting section 426 is larger than that of the positioning member main body 422.

Figure 17:
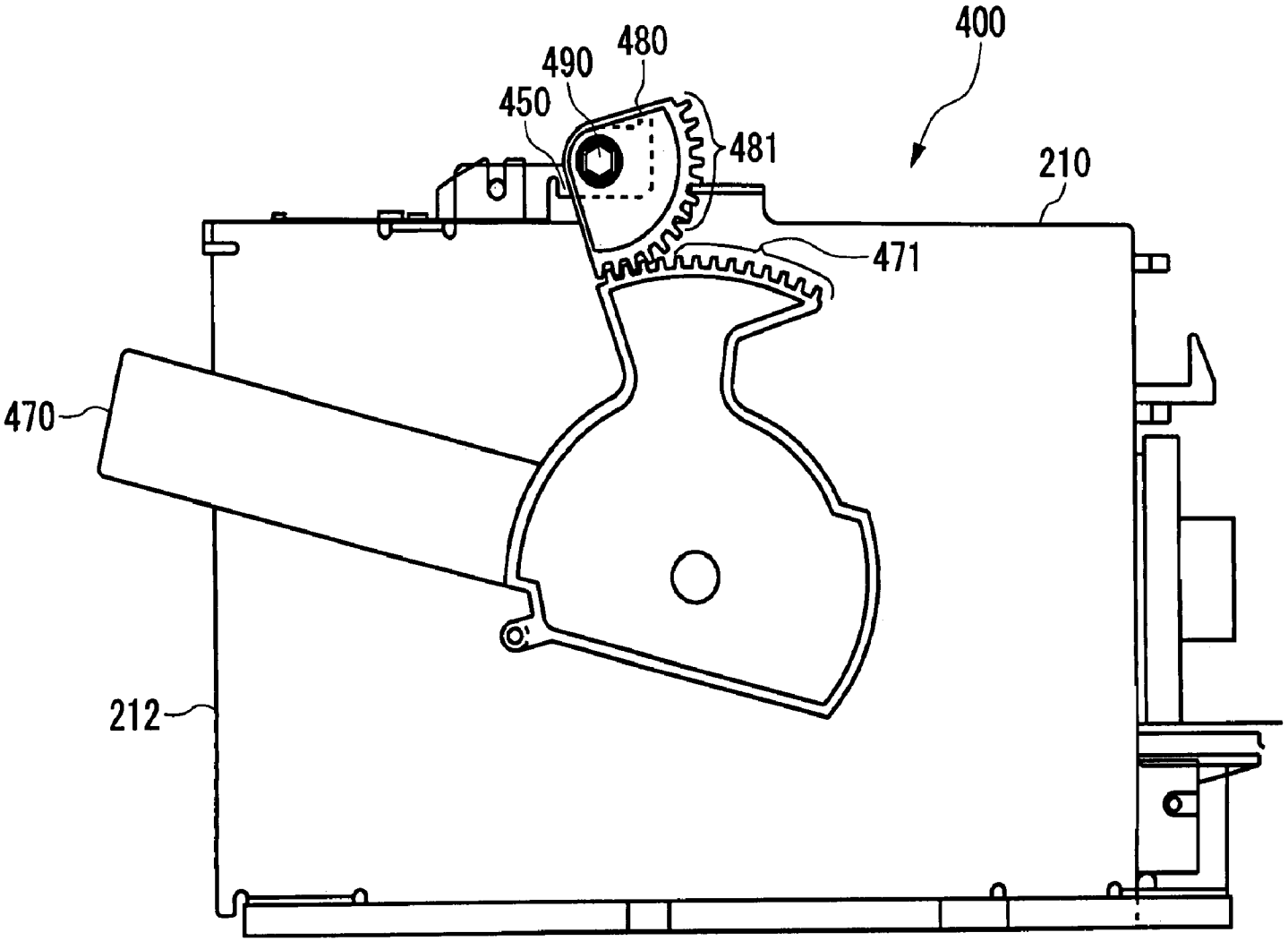
FIG. 17 is a partial side view of one of the ink cartridge holders nearest to a lever viewed from the lever side.

FIG. 17 is a partial side view of one of the ink cartridge holders 400 nearest to the lever 470 of FIG. 16 viewed from the side of the lever 470. A gear 471 of the lever 470 engages with a gear 481 of a gear member 480, and the gear member 480 is connected to a cam 450 through a shaft 490.

The ink cartridge holder 400 further includes a urging section 430 which selectively presses against the second wall 530 of the ink cartridge 500.

The urging section 430 according to the present embodiment includes an contact piece 440 including an abutting section 440*a* which abuts on the projection 532 of the ink cartridge 500, and rotates a little, and the leaf spring 460 which urges the contact piece 440 to the direction of the ink cartridge 300. Furthermore, the urging section 430 includes a cam 450 rotatable between a release position where it does not abut against the leaf spring 460 and a urged position where it does abut against the leaf spring 460. The cam 450 rotates with respect to a shaft 490 in response to the vertical movement of the lever 470 through the gear member 480, the gear 471, and the gear 481 which are connected with the shaft 490. As shown in FIGS. 16 and 17, when the lever 470 of FIG. 11 is raised, the cam 450 comes to be in the release position. When the cam 450 is in the release position, the cam 450 does not abut against the leaf spring 460. Therefore, the contact piece 440 is allowed to rotate upward a little by resisting against the force of the leaf spring 460. On the other hand, when the lever 470 of FIG. 11 is lowered, the cam 450 is in the urged position and the cam 450 abuts on the leaf spring 460. Therefore, the contact piece 440 is not allowed to rotate.

FIGS. 18 through 21 are partial side views showing process of the ink cartridge installation onto the ink cartridge holder according to the second embodiment. However, in order to explain operation of the projection 532 of the ink cartridge 500 and the urging section 420 of the ink cartridge holder 400, the two portions are shown as perspective views.

Figure 18:
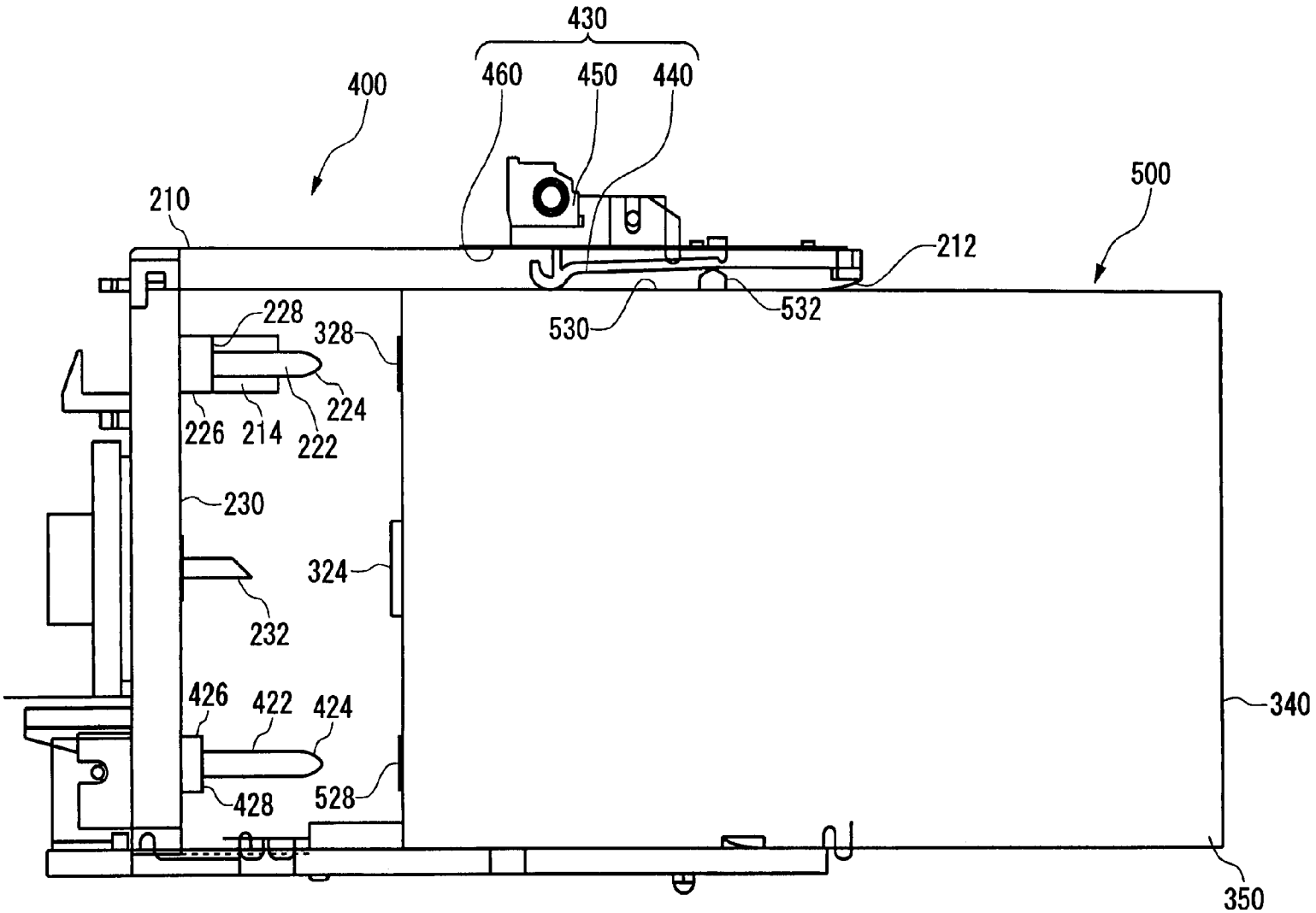
FIG. 18 is a partial side view showing process of the ink cartridge installation to the ink cartridge holder according to the second embodiment.

FIG. 18 is a partial side view showing first step of the installation of the ink cartridge 500 to the ink cartridge holder 400. First, the cam 450 rotates to the release position by raising the lever 470 of FIG. 11. Accordingly, the contact piece 440 is allowed to rotate a little.

The front surface 320 of the ink cartridge 500 is inserted from the opening face 212 of the holder main body 210 of the ink cartridge holder 400. At this time, the positioning member main body 222 of the positioning member 220 of the ink cartridge holder 400 opposes to the port 328 of the positioning section 326 of the ink cartridge 500. Similarly, the end 424 of the sub-positioning member 420 of the ink cartridge holder 400 opposes to the port 528 of the sub-positioning section 526 of the ink cartridge 500. Furthermore, the ink supply needle 232 of the ink cartridge holder 400 opposes to the ink supply port 324 of the ink supply unit 322 of the ink cartridge 500. In the state, the ink cartridge 500 is further inserted into the ink cartridge holder 400 more deeply.

Figure 19:
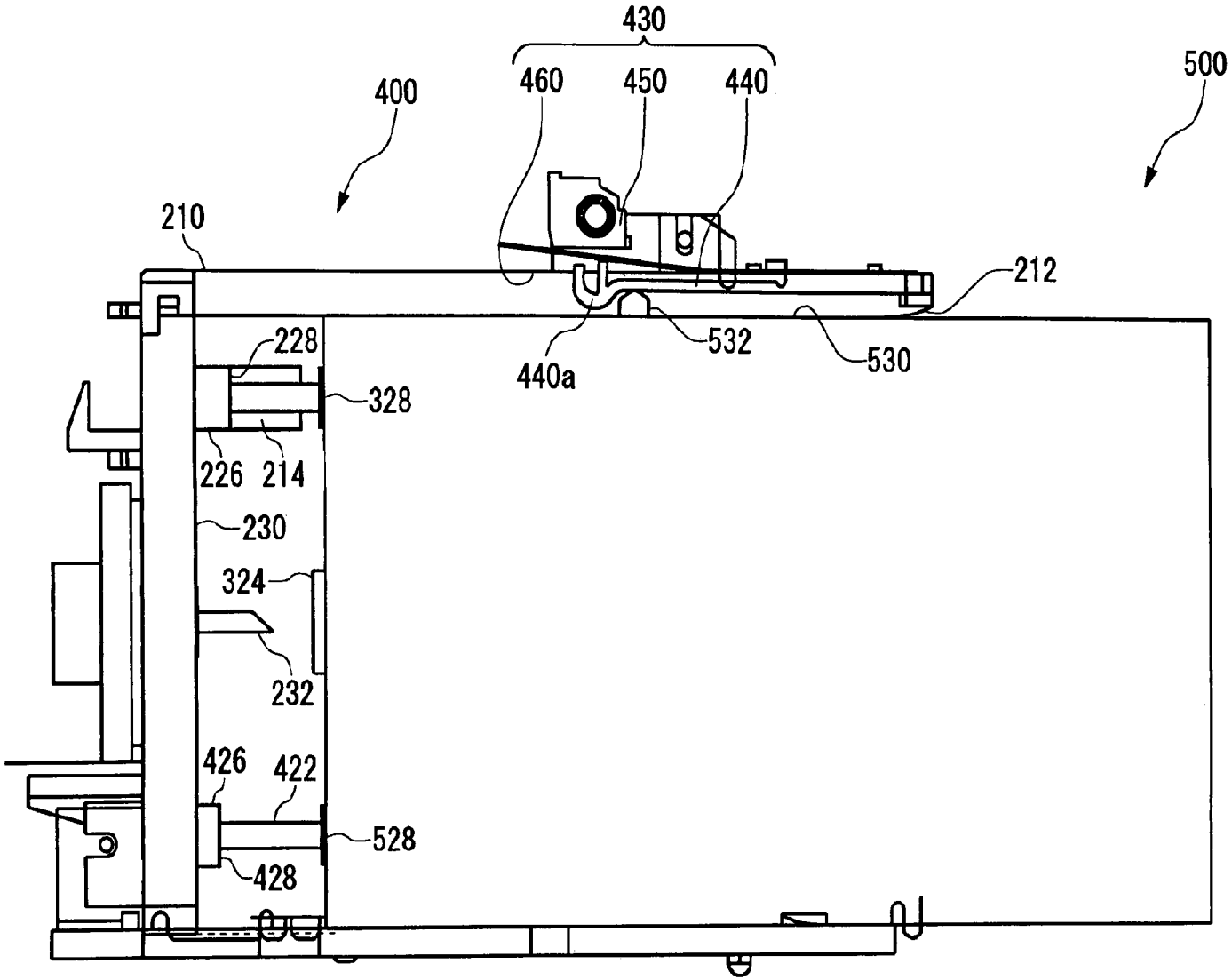
FIG. 19 is a partial side view showing process of the ink cartridge installation to the ink cartridge holder according to the second embodiment.

FIG. 19 is a partial side view showing next step of the ink cartridge installation following FIG. 18. When the ink cartridge 500 is further inserted into the ink cartridge holder 400 more deeply than the state shown in FIG. 18, the end 224 of the positioning member 220 of the ink cartridge holder 400 is inserted in the port 328 of the positioning section 326 of the ink cartridge 500. Moreover, the end 424 of the sub-positioning member 420 of the ink cartridge holder 400 is inserted in the port 528 of the sub-positioning section 526 of the ink cartridge 500.

Since the end 224 of the positioning member 220 is tapered towards the nose from the positioning member main body 222, a position gap between the ink cartridge holder 400 and the ink cartridge 500 is compensated, so that the ink cartridge 500 is guided into the ink cartridge holder 400. Moreover, as explained in reference with FIG. 13, since the width W7 of the major axis in the direction of arrow A is longer than the width W6 of the minor axis in the direction of arrow B, the port 528 of the sub-positioning section 526 limits the fluctuation due to the rotation of the ink cartridge 500 to the ink cartridge holder 400 centering on the positioning member 220, and compensates the variation in length of the ink cartridge 500 and the ink cartridge holder 400 in the direction of the arrow B in FIG. 15.

During the installation of the ink cartridge 500, the projection 532 provided on the second wall 530 of the ink cartridge 500 abuts on the abutting section 440*a* of the contact piece 440 of the urging section 430 of the ink cartridge holder 400. Here, since the contact piece 440 is allowed to rotate upward a little, the projection 532 forces up the contact piece 440 upward resisting the force of the leaf spring 460 during the insertion of the ink cartridge 500.

When the ink cartridge 500 is further inserted into the ink cartridge holder 400 much more deeply, the ink supply needle 232 of the ink cartridge holder 400 is inserted into the ink supply port 324 of the ink supply unit 322 of the ink cartridge 300.

Figure 20:
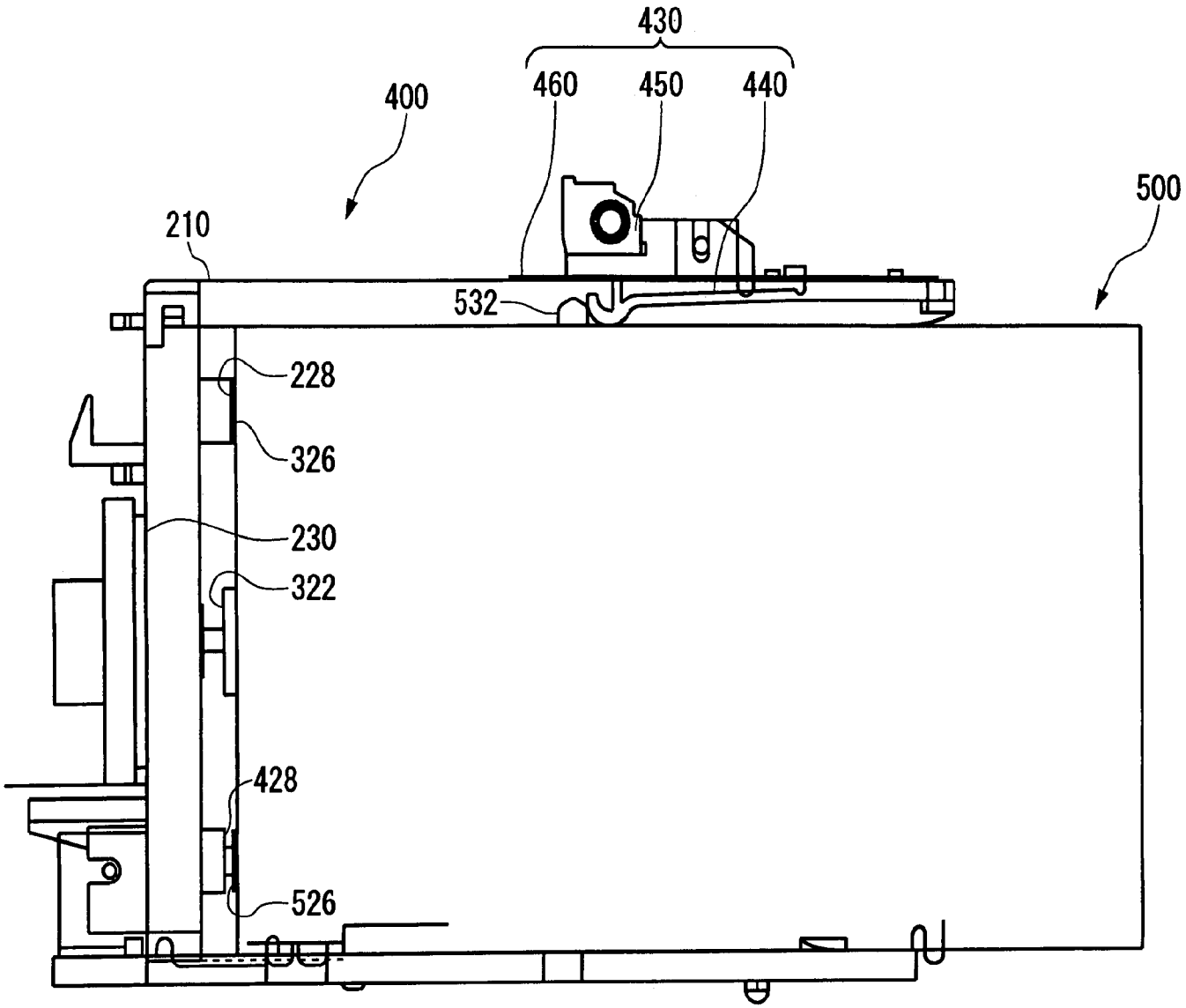
FIG. 20 is a partial side view showing process of the ink cartridge installation to the ink cartridge holder according to the second embodiment.

FIG. 20 is a partial side view showing the next step of the ink cartridge installation following FIG. 19. When the ink cartridge 500 is further inserted into the ink cartridge holder 400 more deeply than the state shown in FIG. 19, the positioning section 326 of the ink cartridge 500 abuts on the abutment surface 228 of the positioning member 220 in the ink cartridge holder 400. Thereby, the insertion of the ink cartridge 500 into the ink cartridge holder 400 is completed.

Although it is not shown in the drawing, the connection electrodes 216 of the information reading section 214 in the ink cartridge holder 201 respectively contact with the connection terminals 316*a* of the connection electrode section 316 of the information storing unit 314 in the ink cartridge 500. Moreover, the projection 532 provided on the second wall 530 of the ink cartridge 500 moves farther from the opening face 212 than the abutting section 440*a* of the contact piece 440 of the urging section 430 of the ink cartridge holder 400, and the contact piece 440 returns to retracted position by the force of the leaf spring 460.

At this time, the distance between the abutment surface 428 of the abutting section 426 of the sub-positioning member 420 and the opening face 212 is longer than the distance between the abutment surface 228 of the abutting section 226 of the positioning member 220 and the opening face 212. Therefore, the sub-positioning section 526 of the ink cartridge 500 does not abut against the abutment surface 428 unless the positioning section 326 abuts on the abutment surface 228. For example, in FIG. 20, there is a gap between the sub-positioning section 526 and the abutment surface 428. Therefore, even if there is variation in the ink cartridge holder 300, the ink cartridge 500, their components and assembly of these components, the abutment surface 228 securely abuts on the positioning section 326, which are positioned in the vicinity of the connection electrode 216 of the information reading section 214 and the connection electrode section 316 of an information storing unit 314.

Figure 21:
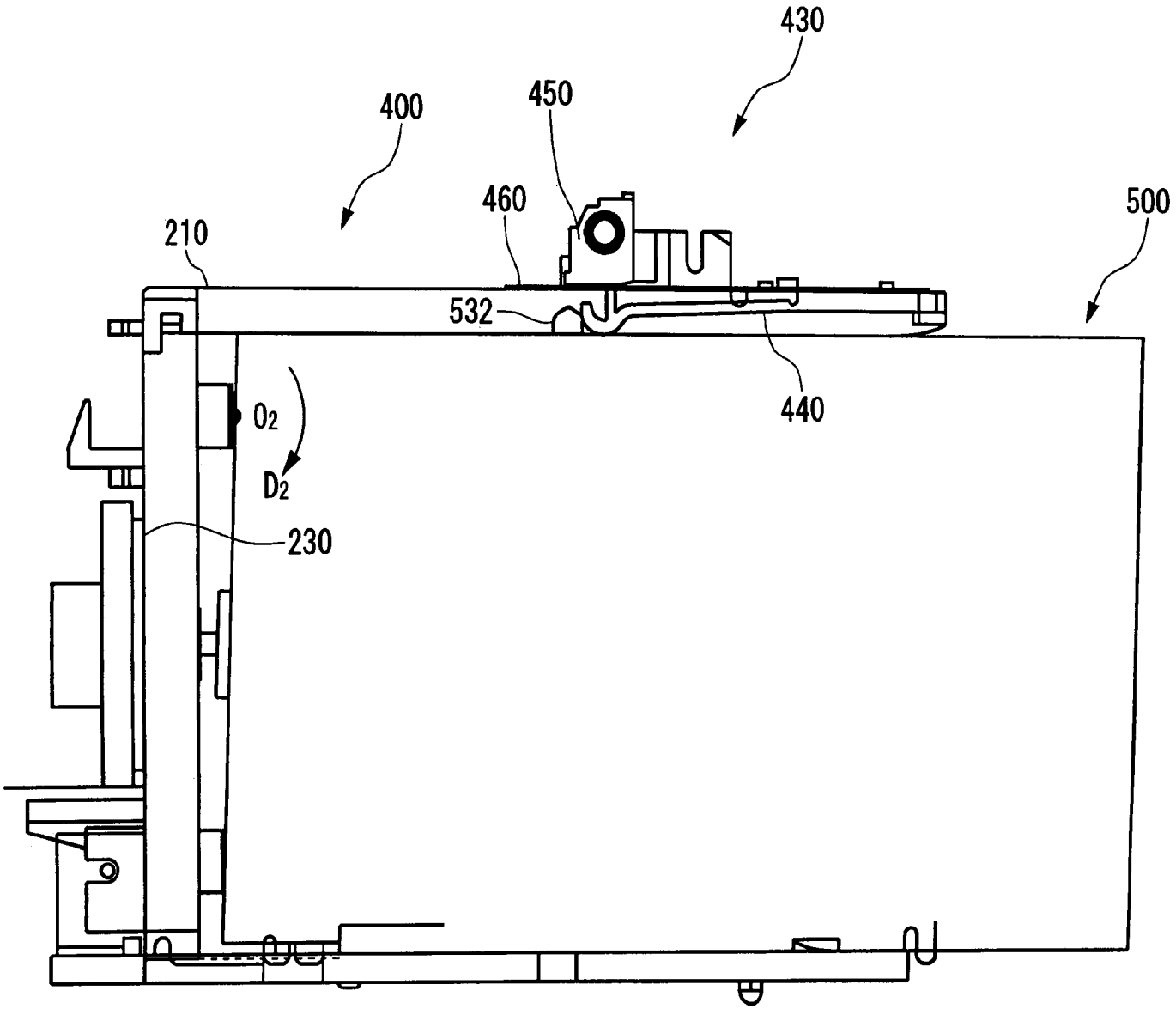
FIG. 21 is a partial side view showing process of the ink cartridge installation to the ink cartridge holder according to the second embodiment.

FIG. 21 is a partial side view shown in FIG. 20, where the lever 470 (shown in FIG. 11) of the urging section 430 is lowered. When the lever 470 is lowered, the cam 450 is caused to rotate to the urged position and abuts on the leaf spring 460. Therefore, the leaf spring 460 urges the contact piece 440 downward. The forced down contact piece 440 securely abuts on the projection 532 of the ink cartridge 500. Accordingly, the ink cartridge 500 is rotated a bit in the ink cartridge holder 201 in the direction of arrow D2 centering on a point O2 in the vicinity of the connection point of the positioning member main body 222 and the positioning section 326.

During the rotation, since the central point O2 of the rotation is in the vicinity of the information reading section 214 and the information storing unit 314, the amount of displacement around the area due to the rotation is very little. On the other hand, although the amount of displacement of the sub-positioning section 526, which is in the position distant from the central point of a rotation, is larger than the displacement of the area around the point O2, since the direction of the major axis of the port 528 is the same as the rotating direction of the ink cartridge 500, the port 528 of the sub-positioning section 526 compensates the displacement in the direction of the rotation.

Consequently, the rotation is limited when the sub-positioning section 526 of the ink cartridge 500 abuts against the abutment surface 428 of the sub-positioning member 420 of the ink cartridge holder 400, or a part of the ink cartridge main body 302 abuts on a part of the holder main body 210. Then, installation of the ink cartridge 500 to the ink cartridge holder 400 is completed.

In addition, when removing the ink cartridge 500 from the ink cartridge holder 400, the lever 470 (shown in FIG. 11) of the ink cartridge holder 400 is raised, and the cam 450 is caused to rotate to the release position. Then, the ink cartridge 500 is drawn out from the opening 212 of the ink cartridge holder 400. At that time, the projection 532 of the ink cartridge 500 pushes up the contact piece 440 resisting the force of the leaf spring 460 of the ink cartridge holder 400.

As mentioned above, according to the second embodiment, the same effect as the first embodiment is achieved. Furthermore, according to the second embodiment, even if there is variation in each components or the like, the ink cartridge is securely fixed to the ink cartridge holder.

In addition, in the ink cartridge holder 400 according to the second embodiment, although the abutment surface 428 of the abutting section 426 of the sub-positioning member 420 is located farther from the opening face 212 than the abutment surface 228 of the abutting section 226 of the positioning member 220, the configuration of these components is not limited to the embodiment. In another embodiment of the ink cartridge 500, the distance between the front surface 320 and the top surface of the positioning section 326 is longer than the distance between the front surface 320 and the top surface of the sub-positioning section 526. Also in this case, the same effect as the second embodiment is achieved.

Alternatively, in the first and second embodiments, the holder main bodies 210 and 410 of the ink cartridge holders 201 and 400 is dimensioned so that there is at least a clearance or some plays at least in the direction parallel to the first wall 310 and the front surface 320 of the ink cartridges 300 and 500, when the ink cartridges 300 and 500 are inserted respectively. In this case, while a user can install the ink cartridge to the ink cartridge holder much more easier, relative position between the connection electrode on the information reading section of the ink cartridge holder and the connection electrode section on the information storing unit of an ink cartridge, which should be aligned accurately, can be maintained. In addition, when the clearance exists in the holder main body 410 of the ink cartridge holder 400 according to the second embodiment, the looseness due to the clearances is compensated by the urging section 430 after the installation of the ink cartridge 500. Therefore, the ink cartridge is securely fixed to the ink cartridge holder.

Figure 22:
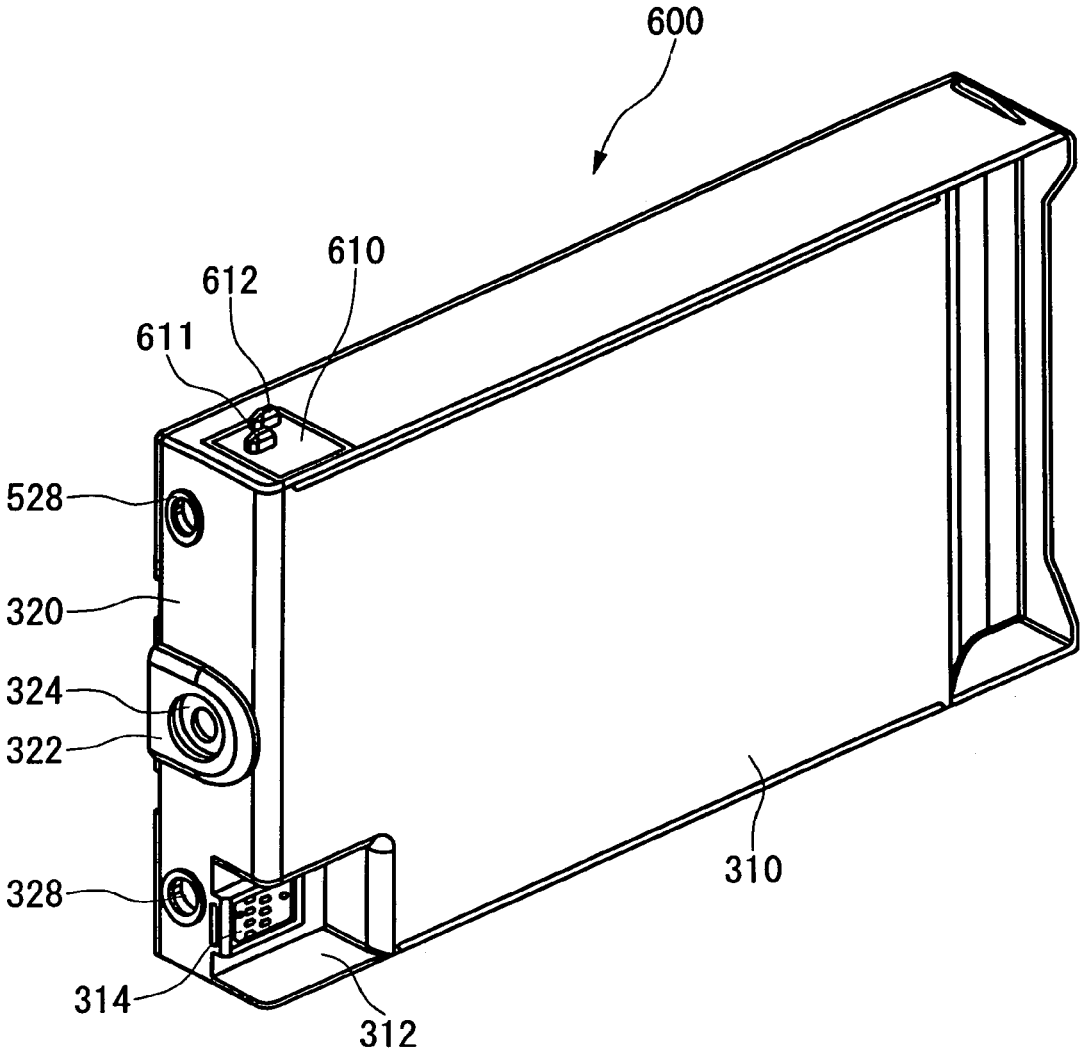
FIG. 22 is a perspective view of the ink cartridge according to a third embodiment.

FIG. 22 is a perspective view of the ink cartridge according to yet another embodiment. An incorrect insertion prevention member 610 is removably provided on the side of the cartridge main body in the vicinity of the front surface 320 so that the ink cartridge is mounted to a proper position of the cartridge holder which holds a plurality of ink cartridges 600. Accordingly, different ink cartridges are constructed from common ink cartridge main bodies by changing the number or location of projections 611 and 612 (see FIG. 22) of the incorrect insertion prevention member 610 for each of the cartridges.

As described above, according to the present invention, even if the ink cartridge has instability to the ink cartridge holder due to the variation in each products, the relative position between the information reading section of the ink cartridge holder and the information storing unit of the ink cartridge, which should be aligned accurately, is maintainable.

Although the present invention has been described by way of an exemplary embodiment, it should be understood that those skilled in the art might make many changes and substitutions without departing from the spirit and the scope of the present invention. It is obvious from the definition of the appended claims that embodiments with such modifications also belong to the scope of the present invention.

What is claimed is:

1. An ink cartridge for supplying ink to a recording apparatus, comprising:

an ink cartridge main body for containing ink therein and comprising a first wall, and a front wall which intersects said first wall;

a connection electrode section provided on a part of said first wall of said ink cartridge main body and including at least one connection electrode electrically connected to a memory element;

an ink supply section provided in said front wall; and an opening, which receives a positioning member of the recording apparatus, located in the front wall, wherein, viewed in an ink cartridge insertion direction, at least a portion of said opening lies within a width range of said connection electrode section.

2. The ink cartridge as claimed in claim 1, wherein the connection electrode section is located in a recessed region of said first wall.

3. The ink cartridge as claimed in claim 1, further comprising a grip section formed at an end of the ink cartridge opposite to the front wall.

4. The ink cartridge as claimed in claim 3, wherein the grip section includes a concave portion.

5. The ink cartridge as claimed in claim 1, wherein the ink cartridge main body is rectangularly parallelepipedal in shape.

6. The ink cartridge as claimed in claim 1, further comprising:

an ink bag to hold the ink, the ink bag being contained in the ink cartridge main body.

7. The ink cartridge as claimed in claim 1, further comprising a plurality of connection electrodes, each said connection electrode having a contact portion, the contact portions being arranged in two parallel rows.

8. The ink cartridge as claimed in claim 7, wherein at least some of the electrodes are rectangular.

9. The ink cartridge as claimed in claim 1, further comprising a substantially elliptical opening located in the front wall, said substantially elliptical opening receiving a positioning member of the recording apparatus.

10. The ink cartridge as claimed in claim 1, wherein the opening guides said ink cartridge along said positioning member of the recording apparatus.

11. The ink cartridge as claimed in claim 1, wherein the opening is a positioning section for guiding said ink cartridge along said positioning member of the recording apparatus.

12. The ink cartridge as claimed in claim 1, wherein the opening has a shape that conforms substantially to a shape of said positioning member of the recording apparatus.

13. The ink cartridge as claimed in claim 1, wherein, viewed in a direction perpendicular to the first wall, a center axis of said opening lies within a width of said connection electrode section.

14. The ink cartridge as claimed in claim 13, wherein the center axis of said opening intersects the front wall perpendicular to the ink cartridge insertion direction, and is substantially aligned with a centerline of said connection electrode section extending in a direction parallel to the first wall and intersecting the front wall perpendicular to the ink cartridge insertion direction.

15. The ink cartridge as claimed in claim 13, further comprising a substantially elliptical opening formed on said front wall, a center axis of said substantially elliptical opening extending in a direction parallel to the ink cartridge insertion direction, and said substantially elliptical opening having a major axis extending perpendicular to the ink cartridge insertion direction.

16. The ink cartridge as claimed in claim 15, wherein a distance between the front surface and a top surface of said port is longer than a distance between the front surface and a top surface of said substantially elliptical opening.

17. The ink cartridge as claimed in claim 13, further comprising at least one projection disposed on a second wall which intersects said first wall of said ink cartridge main body.

18. The ink cartridge as claimed in claim 17, wherein, viewed in a direction perpendicular to the second wall, the projection overlaps a portion of at least one of the connection electrode section and the opening.

* * * * *